US008174518B2

(12) United States Patent
Kwon

(10) Patent No.: US 8,174,518 B2
(45) Date of Patent: May 8, 2012

(54) ORGANIC LIGHT EMITTING DISPLAY AND METHOD OF DRIVING THE SAME

(75) Inventor: Oh-Kyong Kwon, Suwon (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1037 days.

(21) Appl. No.: 12/115,712

(22) Filed: May 6, 2008

(65) Prior Publication Data

US 2009/0027376 A1 Jan. 29, 2009

(30) Foreign Application Priority Data

Jul. 27, 2007 (KR) ..... 10-2007-0075430

(51) Int. Cl.
*G06F 3/038* (2006.01)

(52) U.S. Cl. ..... 345/214; 345/39; 345/46; 345/77

(58) Field of Classification Search ..... 345/39, 345/46, 77, 83
See application file for complete search history.

(56) References Cited

U.S. PATENT DOCUMENTS

| | | | | |
|---|---|---|---|---|
| 7,944,418 | B2 * | 5/2011 | Chung et al. | 345/82 |
| 2009/0027423 | A1 * | 1/2009 | Kwon | 345/690 |

FOREIGN PATENT DOCUMENTS

| | | | |
|---|---|---|---|
| JP | 2005-128272 | A | 5/2005 |
| JP | 2005-258427 | A | 9/2005 |
| JP | 2005-309230 | A | 11/2005 |
| KR | 2002-0046756 | | 6/2002 |
| KR | 10-2006-0029062 | A | 4/2006 |
| KR | 10-2006-0075772 | | 7/2006 |

* cited by examiner

*Primary Examiner* — Amare Mengistu
*Assistant Examiner* — Shawna Stepp Jones
(74) *Attorney, Agent, or Firm* — Christie, Parker & Hale, LLP

(57) ABSTRACT

An organic light emitting display including pixels, each including an organic light emitting diode and a pixel circuit for controlling a supply of an electric current to the organic light emitting diode; and a sensing unit for converting a voltage applied to the organic light emitting diode to a digital value during a sensing period during a sampling period, and for sinking a second current from the pixel corresponding to the digital value to compensate a degradation of the organic light emitting diode during a sampling period.

28 Claims, 11 Drawing Sheets

ORGANIC LIGHT EMITTING DISPLAY AND METHOD OF DRIVING THE SAME

CROSS-REFERENCE TO RELATED APPLICATION

This application claims priority to and the benefit of Korean Patent Application No. 10-2007-0075430, filed on Jul. 27, 2007, in the Korean Intellectual Property Office, the entire content of which is incorporated herein by reference.

BACKGROUND

1. Field of the Invention

The present invention relates to an organic light emitting display and a method of driving the same, and more particularly to an organic light emitting display and a method of driving the same, which compensates for the degradation of organic light emitting diodes.

2. Description of the Related Art

Recently, various flat panel displays capable of reducing weight and volume that are disadvantages of cathode ray tubes (CRTs) have been developed. Flat panel displays include liquid crystal displays (LCDs), field emission displays (FEDs), plasma display panels (PDPs), and organic light emitting displays.

Among the flat panel displays, the organic light emitting displays make use of organic light emitting diodes that emit light by re-combination of electrons and holes. The organic light emitting display has advantages of high response speed and low power consumption.

FIG. 1 is a circuit diagram showing a pixel of a conventional organic light emitting display.

With reference to FIG. 1, a pixel 4 of an organic light emitting display includes an organic light emitting diode OLED and a pixel circuit 2. The pixel circuit 2 is coupled to a data line Dm and a scan line Sn, and controls the organic light emitting diode OLED.

An anode electrode of the organic light emitting diode OLED is coupled to the pixel circuit 2, and a cathode electrode thereof is coupled to a second power source ELVSS. The organic light emitting diode OLED generates light of a luminance corresponding to an electric current from the pixel circuit 2.

When a scan signal is supplied to the scan line Sn, the pixel circuit 2 controls an amount of an electric current provided to the organic light emitting diode OLED corresponding to a data signal provided to the data line Dm. To do this, the pixel circuit 2 includes a first transistor M1, a second transistor M2, and a storage capacitor C. The second transistor M2 is coupled between a first power source ELVDD and the organic light emitting diode OLED. The first transistor M1 is coupled between the data line Dm and the scan line Sn. The storage capacitor C is coupled between a gate electrode and a first electrode of the second transistor M2.

A gate electrode of the first transistor M1 is coupled to the scan line Sn, and a first electrode of the first transistor M1 is coupled to the data line Dm. A second electrode of the first transistor M1 is coupled to one terminal of the storage capacitor C. Here, the first electrode of the first transistor M1 is one of a source electrode or a drain electrode, and the second electrode is the other one of the source electrode or the drain electrode. For example, when the first electrode is the source electrode, the second electrode is the drain electrode. When a scan signal is supplied to the first transistor M1 coupled with the scan line Sn and the data line Dm, the first transistor M1 is turned on and provides a data signal from the data line Dm to the storage capacitor C. At this time, the storage capacitor C is charged with a voltage corresponding to the data signal.

A gate electrode of the second transistor M2 is coupled to one terminal of the storage capacitor C, and a first electrode of the second transistor M2 is coupled to another terminal of the storage capacitor C and a first power source ELVDD. Further, a second electrode of the second transistor M2 is coupled to an anode electrode of the organic light emitting diode OLED. The second transistor M2 controls an amount of an electric current flowing from the first power source ELVDD to a second power source ELVSS through the organic light emitting diode OLED according to the voltage charged in the storage capacitor C. At this time, the organic light emitting diode OLED emits light with a luminance corresponding to the amount of electric current supplied through the second transistor M2.

The pixel 4 of the organic light emitting display displays images of a desired luminance by repeating the aforementioned procedure. On the other hand, during a digital drive in which the second transistor M2 functions as a switch, a voltage of the first power source ELVDD and a voltage of the second power source ELVSS are supplied to the organic light emitting diode OLED. Accordingly, the organic light emitting diode OLED emits light with a regulated voltage drive. In the digital drive method, gradations of luminance, or gray levels are expressed using an emission time of the organic light emitting diode OLED while supplying a constant current to the organic light emitting diode OLED. However, in the digital drive method, because the organic light emitting diode OLED emits light with a regulated voltage drive, a degradation of the organic light emitting diode OLED progresses more quickly, with the eventual result that images of desired luminance cannot be displayed.

When the organic light emitting diode OLED degrades, resistance of the organic light emitting diode OLED increases. Accordingly, an electric current flowing to the organic light emitting diode OLED is reduced corresponding to the same voltage. This causes the luminance of images to be reduced.

SUMMARY OF THE INVENTION

Accordingly, it is an aspect of an exemplary embodiment of the present invention to provide an organic light emitting display and a method for driving the same, which compensates for the degradation of organic light emitting diodes.

The foregoing and/or other aspects of the present invention are achieved by providing an organic light emitting display with a plurality of pixels, each pixel including an organic light emitting diode and a pixel circuit. The pixel circuit controls a supply of an electric current to the organic light emitting diode. The display further includes a sensing unit for supplying a first current to the organic light emitting diode in each of the pixels and converting a voltage applied to the organic light emitting diode to a digital value during a sensing period, and for sinking a second current from the pixel corresponding to the digital value to compensate for a degradation of the organic light emitting diode during a sampling period. The second current is a function of a selected current value among I current values, where I is a natural number (i.e., a positive integer) corresponding to a gradation of data, and a compensation current adapted to compensate for the degradation of the organic light emitting diode.

According to one embodiment, the sensing unit includes a current source unit, a current digital-analog converter (current DAC), a switching unit, an analog-digital converter (ADC), a memory, and a controller. The current source unit supplies the first current during the sensing period. The current DAC sinks the second current during the sampling period. The switching unit selectively couples the current source unit and the current DAC to a feedback line among a plurality of feedback lines, wherein each feedback line is coupled to at least one pixel among the plurality of pixels. The ADC is coupled to the current source unit, and converts a voltage applied to the organic light emitting diode to the digital value; and the memory stores that digital value. The controller controls the current DAC to compensate for the degradation of the organic light emitting diode utilizing the digital value stored in the memory. According to a further embodiment, the current source unit, the switching unit, and the current digital-analog converter are coupled to every channel.

The switching unit includes a first switch coupled between the feedback line and the current source unit, and a second switch coupled between the feedback line and the current digital-analog converter. The first switch is turned on during the sensing period, and the second switch is turned-on during the sampling period.

According to a further embodiment, the current DAC includes a first current generator for generating a third current and a fourth current corresponding to a smallest gradation, among the I current values divided corresponding to the gradation of the data; a first current sink unit for sinking a fifth current, the fifth current corresponding to the third current supplied by the first current generator; a second current sink unit for sinking a sixth current, wherein the sixth current is the compensation current, the sixth current corresponding to the fourth current supplied by the first current generator, and adapted to compensate for the degradation of the organic light emitting diode; a second current generator for generating a seventh current corresponding to a sum of the fifth current and the sixth current sunk by the first current sink unit and the second current sink unit, respectively; and a third current sink unit for sinking the second current from the feedback line, the second current corresponding to the seventh current multiplied by a factor of β (β is a natural number), β corresponding to the gradation of the data.

According to a further embodiment, the first current sink unit includes at least one first transistor being diode-connected for receiving the third current, and at least one second transistor coupled to the first transistor as a current mirror for sinking the fifth current.

According to a further embodiment, the second current sink unit includes at least one third switch coupled to the second current generator, and being selectively turned on and off under a control of the controller; at least one third transistor coupled to the first current generator, the at least one third transistor for receiving the fourth current supplied by the first current generator; and at least one fourth transistor coupled to the at least one third switch, and coupled to the at least one third transistor as a current mirror for sinking the sixth current.

According to a further embodiment, a number of fourth transistors coupled to the at least one third switch corresponds to $2^k$ (k=0, 1, 2, 3, . . . ) for each third switch, wherein the at least one third switch comprises (k+1) switches. According to a further embodiment, the number of the third transistors is the same as that of the fourth transistors. According to another embodiment, the controller controls turning on and off of the third switches so that the sixth current adapted to compensate for the degradation of the organic light emitting diode is sunk from the second current generator.

According to another embodiment, the second current generator includes at least one first transistor being diode-connected, wherein the sum of the fifth current and the sixth current sunk by the first current sink unit and the second current sink unit, respectively, flows through the at least one first transistor; and at least one second transistor coupled to the first transistor as a current mirror for supplying the seventh current to the third current sink unit, the seventh current corresponding to the sum of the fifth current and the sixth current.

According to another embodiment, the third current sink unit includes at least one third switch coupled to the switching unit and being selectively turned on and off under a control of a data driver; at least one first transistor coupled to the second current generator for receiving the seventh current; and at least one second transistor coupled to the at least one third switch, and coupled to the at least one first transistor as a current mirror for sinking the second current. The data driver may control turning on and off of the third switches utilizing upper bits of the data to sink the second current, corresponding to the seventh current multiplied by the factor of β.

According to another embodiment, the current digital-analog converter includes a first current generator for generating a third current corresponding to a smallest gradation among the I current values divided corresponding to the gradation of the data; a first current sink unit for receiving the third current from the first current generator, and for sinking a fourth current, the fourth current corresponding to the third current multiplied by a factor of β (β is a natural number), β corresponding to the gradation of the data; a second current generator for generating a fifth current and a sixth current corresponding to the fourth current sunk by the first current sink unit; a second current sink unit for sinking a seventh current corresponding to the fifth current supplied by the second current generator; and a third current sink unit for sinking an eighth current, wherein the eighth current is the compensation current, the eighth current corresponding to the sixth current supplied by the second current generator, and adapted to compensate for the degradation of the organic light emitting diode.

According to a further embodiment, the first current sink unit includes at least one first transistor being diode-connected for receiving the third current; at least one third switch coupled to the second current generator, and being selectively turned on and off under a control of a data driver; and at least one second transistor coupled to the at least one third switch, and coupled to the at least one first transistor as a current mirror for sinking the fourth current.

According to another embodiment, the data driver controls turning on and off of the at least one third switch utilizing upper bits of the data to sink the fourth current, corresponding to the third current multiplied by the factor of β. The second current sink unit may include at least one first transistor diode-connected and for receiving the fifth current; and at least one second transistor coupled to the first transistor as a current mirror for sinking the seventh current. The third current sink unit may include at least one third switch coupled to the switching unit and being selectively turned on and off under a control of the controller; at least one third transistor being diode-connected and for receiving the the sixth current; and at least one fourth transistor coupled to the at least one third switch, and coupled to the at least one third transistor as a current mirror for sinking the eighth current, adapted to compensate for the degradation of the organic light emitting diode.

A number of the fourth transistors coupled to the at least one third switch may correspond to $2^k$ (k=0, 1, 2, 3, . . . ) for each third switch, wherein the at least one third switch comprises (k+1) switches. A number of the third transistors should be the same as that of the fourth transistors. The controller may control turning on and off of the third switches so that the eighth current adapted to compensate for the degradation of the organic light emitting diode is sunk from the pixel. According to a further embodiment, one frame comprises a plurality of sub frames, and the sampling period is an initial period of the one frame. The sensing period may correspond to a time when a power is supplied to the organic light emitting display.

According to another embodiment, the organic light emitting display further comprises a data driver for selectively supplying a first data signal and a second data signal to data lines coupled to the pixels, the first data signal and the second data signal causing the pixels to emit light and not to emit light, respectively; a scan driver for supplying a first scan signal and a second scan signal to first scan lines and second scan lines coupled to the pixels, respectively; and a control line driver for supplying a control signal to control lines coupled to the pixels.

According to a further embodiment, the data driver includes a shift register unit for sequentially generating sampling signals; a sampling latch unit for sequentially storing image data in response to the sampling signals and generating latched data; a holding latch unit for temporarily storing the latched data from the sampling latch unit and generating holding data; and a signal generator for receiving lower bits of the holding data from the holding latch unit and for generating the first data signal or the second data signal, wherein upper bits of the holding data except the lower bits are supplied to the sensing unit.

Each of the pixels may include a second transistor coupled to the feedback line, and being turned on when the first scan signal is supplied to the first scan line; a first transistor including a gate electrode coupled to a second electrode of the second transistor, for supplying an electric current to the organic light emitting diode; a first capacitor coupled between a gate electrode and a first electrode of the first transistor, the first capacitor being charged with a voltage corresponding to the second current; a third transistor coupled between a second electrode of the first transistor and the feedback line, and being turned on when the first scan signal is supplied to the first scan line; a fourth transistor coupled between the first transistor and the organic light emitting diode; a second capacitor coupled between the fourth transistor and the first electrode of the first transistor, the second capacitor being charged with a voltage corresponding to the first data signal or the second data signal; a fifth transistor coupled between the fourth transistor and the data line, and being turned on when the second scan signal is supplied to the second scan line; and a sixth transistor coupled between an anode electrode of the organic light emitting diode and the feedback line, and being turned on when a control signal is supplied to the control line. The fifth transistor may be turned on during the sensing period and the sampling period to receive the second data signal from the data line.

The sixth transistor may be turned on during the sensing period. The second transistor and the third transistor may be turned on during the sampling period. The second capacitor may be charged with the voltage corresponding to the first data signal or the second data signal when the second scan signal is sequentially supplied during a sub frame period.

According to another aspect of the present invention, there is provided a method for driving an organic light emitting display, the method including supplying a first current to organic light emitting diodes included in pixels during a sensing period; converting voltages applied to the organic light emitting diodes corresponding to the first current to digital values and storing the digital values in a memory; sinking a second current from the pixels during a sampling period, wherein the second current is adapted, by utilizing the digital values stored in the memory, to compensate for a degradation of the organic light emitting diodes; and charging the pixels with a voltage corresponding to the second current while sinking the second current, wherein the second current is a function of a selected current value among I (I is a natural number) current values corresponding to a gradation of data, and a compensation current adapted to compensate for the degradation of the organic light emitting diode.

The digital values corresponding to each of the pixels may be stored in the memory during the sensing period. The sensing period may be when a power is supplied to the organic light emitting display. One frame may comprise a plurality of sub frames, and the sampling period may be a first sub frame of the one frame. According to a further embodiment, the method further comprises selectively supplying a first data signal and a second data signal to the pixels during a scan period of the sub frames, the first data signal and the second data signal causing the pixels to emit light and not to be emit light, respectively; and supplying the second current to an organic light emitting diode of each of the pixels when the pixels receive the first data signal.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
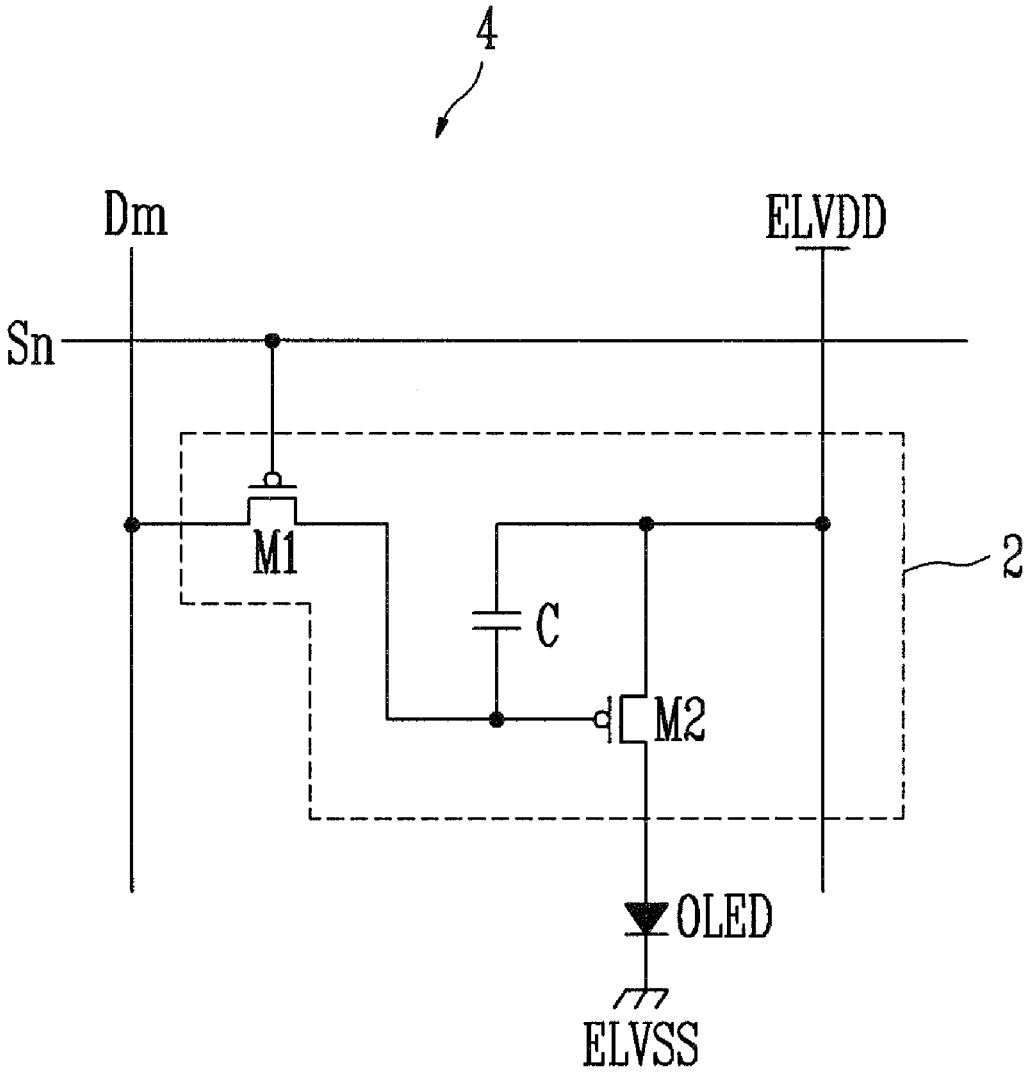
FIG. 1 (PRIOR ART)
FIG. 1 is a circuit diagram showing a pixel of a conventional organic light emitting display.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Figure 2:
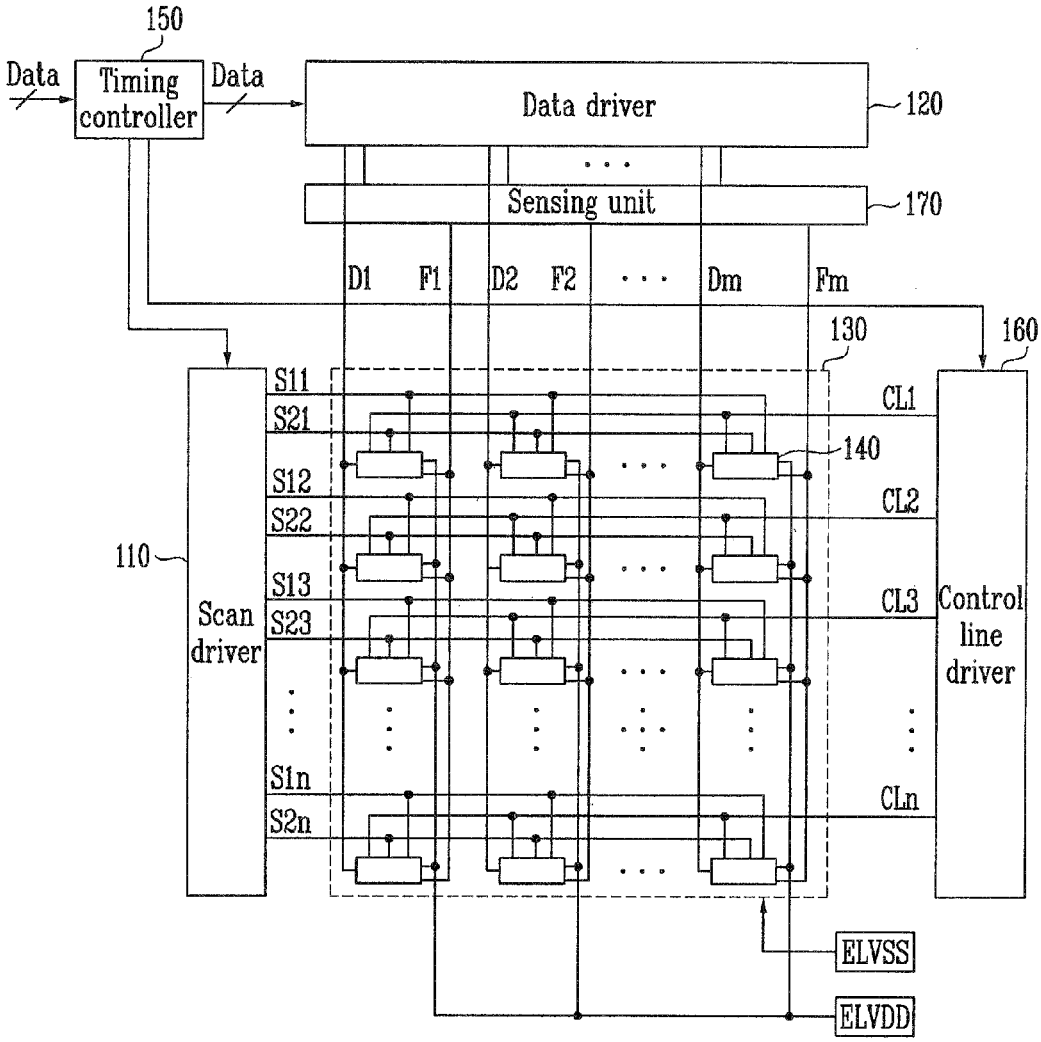
FIG. 2 is a schematic block diagram showing an organic light emitting display according to an embodiment of the present invention.

FIG. 2 is a schematic block diagram showing an organic light emitting display according to an exemplary embodiment of the present invention.

With reference to FIG. 2, the organic light emitting display according to the embodiment of the present invention includes a display portion 130 having pixels 140, a scan driver 110, a control line driver 160, a data driver 120, and a timing controller 150. The pixels 140 are coupled to first scan lines S11 through S1*n*, second scan lines S21 through S2*n*, data lines D1 through Dm, feedback lines F1 through Fm, and control lines CL1 through CLn. The scan driver 110 drives the first scan lines S11 through S1*n* and the second scan lines S21 through S2*n*. The control line driver 160 drives the control lines CL1 through CLn. The data driver 120 drives the data lines D1 through Dm. The timing controller 150 controls the scan driver 110, the control line driver 160, and the data driver 120.

The organic light emitting display according to the above embodiment of the present invention further includes a sensing unit 170. The sensing unit 170 senses degradation information of an organic light emitting diode included in each of the pixels 140 using the feedback lines F1 through Fm, and charges a voltage for compensating the degradation of the organic light emitting diode corresponding to the sensed degradation information thereof in the pixels 140.

The display portion 130 includes pixels 140, which are disposed at crossings of the first scan lines S11 through S1*n*, the second scan lines S21 through S2*n*, the data lines D1 through Dm, the feedback lines F1 through Fm, and the control lines CL1 through CLn. The pixels 140 receive a first power source ELVDD and a second power source ELVSS from the outside. The pixels 140 control an electrical coupling between the first power source ELVDD and the organic light emitting diode.

Here, the pixels 140 control at least two variables corresponding to gradations, to supply an electric current to their respective organic light emitting diodes. Namely, in the present invention, gradations are attained utilizing an emission time and a value of a current through the organic light emitting diode.

The scan driver 110 supplies a first scan signal to the first scan lines S11 to S1*n*, and supplies a second scan signal to the second scan lines S21 to S2*n*. A detailed description of the first scan signal and the second scan signal supplied by the scan driver 110 will be given later.

The control line driver 160 supplies a control signal to the control lines CL1 through CLn during a sensing period. Here, the sensing period corresponds to a time when power from a power source is applied to the organic light emitting display, or some other time previously set by a user. The sensing period is when the sensing unit 170 extracts degradation information of the organic light emitting diode included in each of the pixels 140.

The data driver 120 supplies the second data signal to the data lines D1 through Dm during the sensing period and the sampling period. Further, the data driver 120 supplies a first data signal or a second data signal to the data lines D1 through Dm during the normal driving period, or during a frame. Here, the first data signal is a voltage to cause the pixels to emit light. The second data signal is a voltage to cause the pixels not to emit light.

The sensing unit 170 extracts degradation information of the organic light emitting diode during the sensing period, and adjusts an electric current sunk by a current digital-analog converter (referred to as 'current DAC' hereinafter) (not shown) so that the extracted degradation information of the organic light emitting diode may be compensated. Further, the sensing unit 170 charges a voltage within the pixels during the sampling period of the one frame period to compensate for the degradation of the organic light emitting diodes.

Here, the electric current sunk in the current DAC includes at least two current values corresponding to a gradation of data Data. Namely, the electric current sunk in the current DAC compensates for the degradation of the organic light emitting diode and is determined as a current value corresponding to the gradation of the data Data. The sensing unit 170 will be described in detail later.

The timing controller 150 controls the scan driver 110, the data driver 120, and the control line driver 160. Further, the timing controller 150 transfers data Data supplied from an exterior to the data driver 120.

Figure 3:
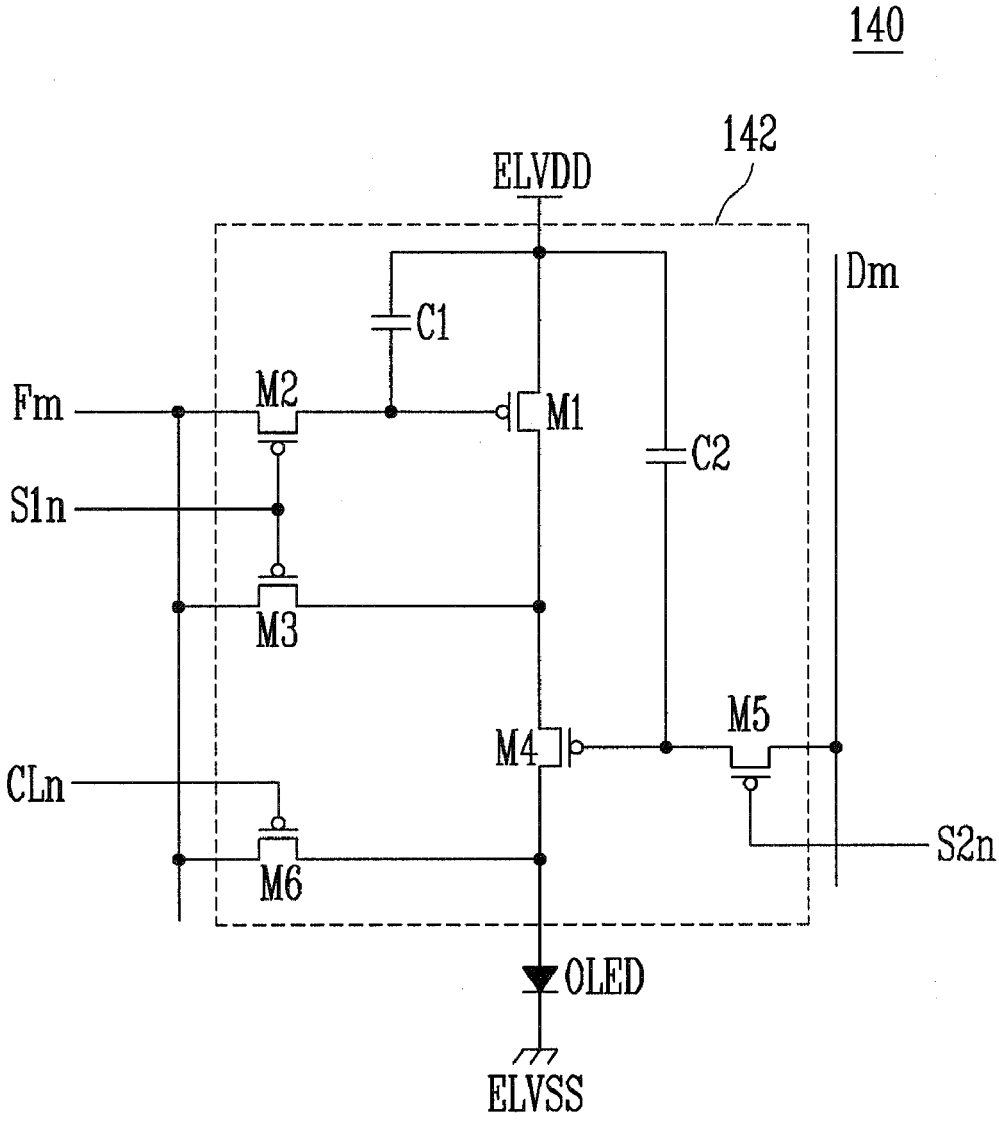
FIG. 3 is a circuit diagram showing an example of the pixel shown in FIG. 2.

FIG. 3 is a circuit diagram showing an exemplary embodiment of the pixel 140 shown in FIG. 2. For convenience of description, FIG. 3 shows the pixel coupled to the m-th data line Dm, the n-th first scan line S1*n*, and the n-th second scan line S2*n*.

With reference to FIG. 3, the pixel 140 according to the embodiment of the present invention includes an organic light emitting diode OLED and a pixel circuit 142. The pixel circuit 142 supplies an electric current to the organic light emitting diode OLED.

An anode electrode of the organic light emitting diode OLED is coupled to the pixel circuit 142, and a cathode electrode of the organic light emitting diode OLED is coupled to the second power source ELVSS. The organic light emitting diode OLED emits or does not emit light corresponding to an electric current supplied from the pixel circuit 142.

The pixel circuit 142 charges a voltage (e.g., a predetermined voltage) corresponding to an electric current sunk from the feedback line Fm to a first capacitor C1 when a first scan signal is supplied to the first scan line S1*n*. Further, when the second scan signal is supplied to the second scan line S2*n*, the pixel circuit 142 charges a voltage corresponding to the data signal on the data line Dm in a second capacitor C2. Here, when the first data signal is supplied on the data line Dm, the second capacitor C2 is charged with a turning-on voltage of the fourth transistor M4. In contrast to this, when the second data signal is supplied on the data line Dm, the second capacitor C2 is charged with a turning-off voltage of the fourth transistor M4. When the first data signal is supplied on the data line Dm, the pixel circuit 142 supplies an electric current corresponding to the voltage charged in the first capacitor C1 to the organic light emitting diode OLED for a period of time, which may be predetermined. To do this, the pixel circuit 142 includes six transistors M1 through M6, a first capacitor C1, and a second capacitor C2.

A gate electrode of the second transistor M2 is coupled to the first scan line S1*n*, and a first electrode of the second transistor M2 is coupled to the feedback line Fm. Further, a second electrode of the second transistor M2 is coupled to a gate electrode of the first transistor M1 and a first terminal of the first capacitor C1. When a first scan signal is supplied to the first scan line S1*n*, the second transistor M2 is turned on.

The gate electrode of the first transistor M1 is coupled to the second electrode of the second transistor M2, and a first electrode of the first transistor M1 is coupled to a first power source ELVDD and a second terminal of the first capacitor C1. A second electrode of the first transistor M1 is coupled to a first electrode of a fourth transistor M4. The first transistor M1 supplies an electric current to the fourth transistor M4 corresponding to a voltage charged in the first capacitor C1.

A gate electrode of the third transistor M3 is coupled to the first scan line S1*n*, and a first electrode of the third transistor M3 is coupled to the second electrode of the first transistor M1. Further, a second electrode of the third transistor M3 is coupled to the feedback line Fm. When the first scan signal is supplied to the first scan line S1*n*, the third transistor M3 is turned on.

A gate electrode of the fourth transistor M4 is coupled to a second electrode of the fifth transistor M5, and a first electrode of the fourth transistor M4 is coupled to the second electrode of the first transistor M1. Further, a second electrode of the fourth transistor M4 is coupled to an anode electrode of the organic light emitting diode OLED. The fourth transistor M4 is turned on/off according to a voltage charged in the second capacitor C2.

A gate electrode of the fifth transistor M5 is coupled to a second scan line S2*n*, and a first electrode of the fifth transistor M5 is coupled to a data line Dm. Further, a second electrode of the fifth transistor M5 is coupled to the gate electrode of the fourth transistor M4. When a second scan signal is supplied to the second scan line S2*n*, the fifth transistor M5 is turned on.

A gate electrode of the sixth transistor M6 is coupled to a control line CLn, and a first electrode of the sixth transistor M6 is coupled to the feedback line Fm. Further, a second electrode of the sixth transistor M6 is coupled to the anode electrode of the organic light emitting diode OLED. When a control signal is supplied to the control line CLn, the sixth transistor M6 is turned on.

The first capacitor C1 is coupled between the gate electrode and the first electrode of the first transistor M1. The first capacitor C1 is charged with a voltage applied to the gate electrode of the first transistor M1 corresponding to an electric current that is sunk in the feedback line Fm.

The second capacitor C2 is coupled between the first power source ELVDD and the gate electrode of the fourth transistor M4. The second capacitor C2 is charged with a voltage corresponding to a data signal from the data line Dm. Here, the second capacitor C2 is charged with a voltage capable of turning on the fourth transistor M4 when the first data signal is supplied thereto. In contrast to this, the second capacitor C2 is charged with a voltage capable of turning off the fourth transistor M4 when the second data signal is supplied thereto.

Figure 4:
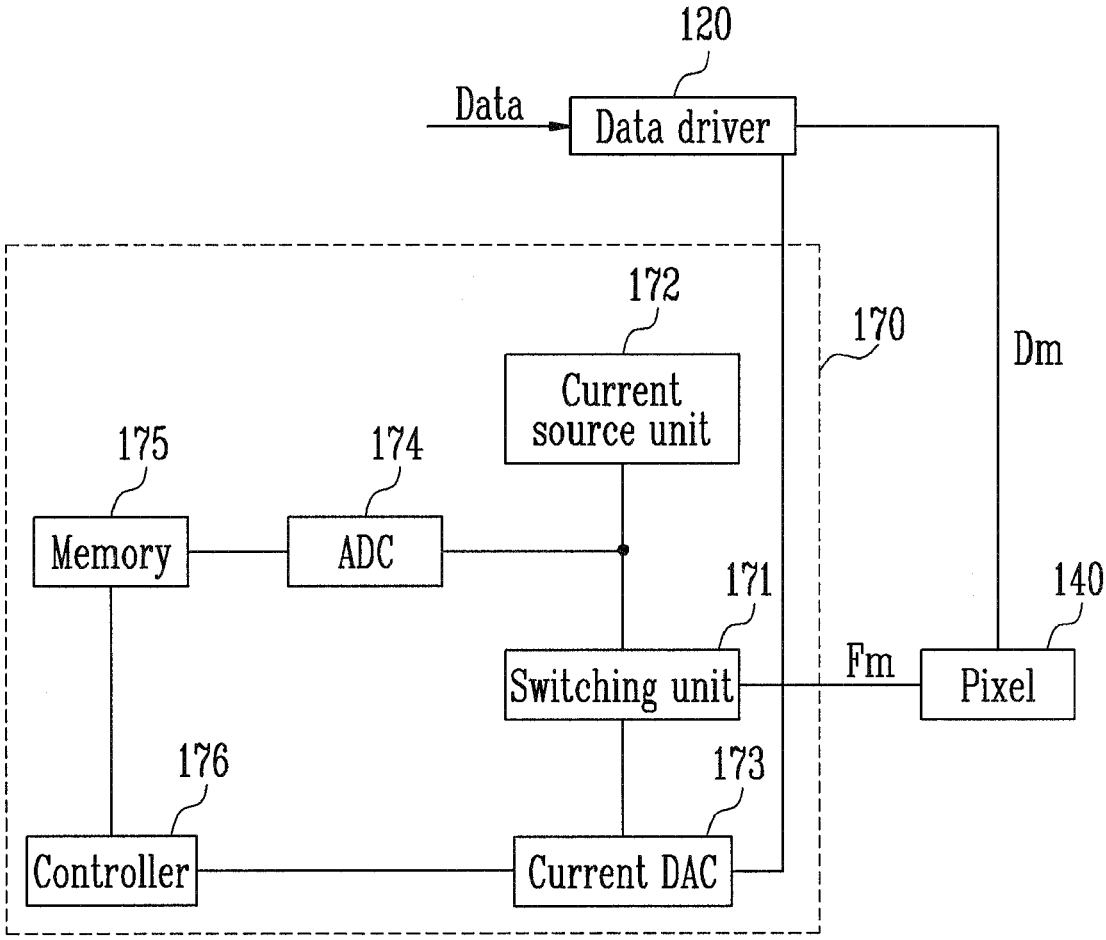
FIG. 4 is a schematic block diagram showing the sensing unit shown in FIG. 2.

FIG. 4 is a schematic block diagram illustrating an exemplary embodiment of the sensing unit 170 shown in FIG. 2. For convenience of description, FIG. 4 shows the sensing unit coupled to an m-th feedback line Fm.

With reference to FIG. 4, the sensing unit 170 includes multiple channels, each channel coupled to a respective one of feedback lines F1 to Fm. Each channel of the sensing unit 170 includes a switching unit 171, a current source unit 172, and a current DAC 173. Further, the sensing unit 170 includes an analog-digital converter (referred to as 'ADC') 174, a memory 175, and a controller 176, which are coupled to the switching unit 171 in common to each channel. In other words, the ADC 174, the memory 175, and the controller 176 are shared by all channels of the sensing unit 170. Here, the ADC 174 is coupled in common to all channels of the sensing unit according to the described embodiment of the present invention. However, the present invention is not limited thereto. For example, another embodiment of the present invention may include three ADCs 174, which are respectively coupled to a red pixel, a green pixel, and a blue pixel.

Figure 5:
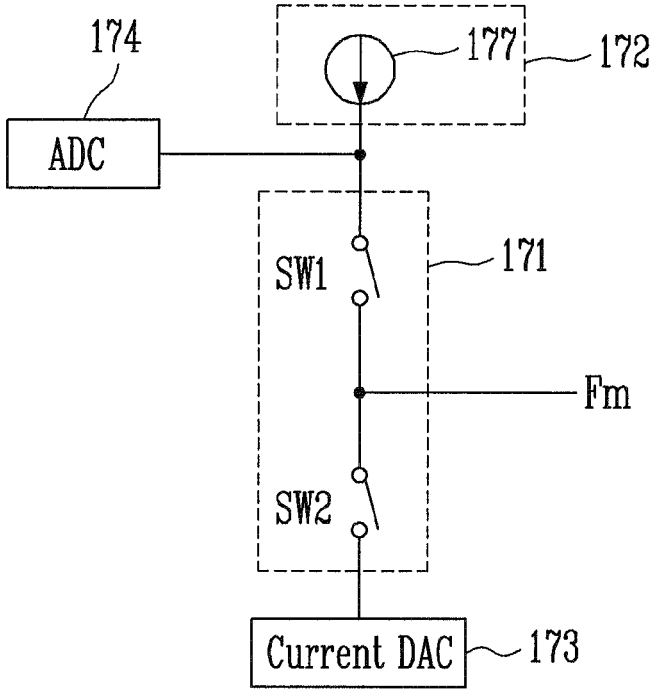
FIG. 5 is a schematic block diagram showing the switching unit shown in FIG. 4.

As shown in FIG. 5, an exemplary embodiment of the switching unit 171 includes a first switch SW1 and a second switch SW2. The first switch SW1 is coupled between the feedback line Fm and the current source unit 172. The second switch SW2 is coupled between the feedback line Fm and the current DAC 173.

The first switch SW1 is turned on during the sensing period. When the first switch SW1 is turned on, the feedback line Fm is electrically coupled to the current source unit 172 and the ADC 174.

The second switch SW2 is turned on during the sampling period. When the second switch SW2 is turned on during the sampling period, the feedback line Fm and the current DAC 173 are electrically coupled to each other. Here, the sampling period is an initial period located at the beginning of one frame period. A detailed description of the sampling period will be given later.

The current source unit 172 supplies an approximately constant current to the feedback line Fm. To do this, the current source unit 172 includes a current source 177. The current source 177 supplies a current (e.g., a predetermined current) to the feedback line Fm. Here, the current value of the current source 177 causes a voltage to be applied to the organic light emitting diode OLED that corresponds to degradation information to the organic light emitting diode OLED. In practice, the current value of the current source 177 may be experimentally and variously set so that a suitable voltage (e.g., a predetermined voltage) is applied to the organic light emitting diode OLED.

The ADC 174 converts the voltage applied to the organic light emitting diode OLED to a digital value when the electric current is supplied from the current source unit 172 to the pixel 140.

The memory 175 stores the digital value supplied from the ADC 174. According to one embodiment, the memory 175 has a capacity to include digital values of all the pixels 140 included in the display portion 130.

The controller 176 determines degradation information of an organic light emitting diode OLED included in each of pixels 140 using the digital values stored in the memory 175, and controls the current DAC 173 to compensate for the determined degradation information of the organic light emitting diode OLED.

In detail, when an electric current is supplied from the current source unit 172 to the pixel 140, a suitable voltage (e.g., a predetermined voltage) is applied to the organic light emitting diode OLED. Here, the more the organic light emitting diode OLED has degraded, the greater the voltage applied to the organic light emitting diode OLED is. Accordingly, the digital values stored in the memory 175 include the degradation information of the organic light emitting diode OLED. For example, when the organic light emitting diode OLED is not degraded, value "0000" is stored in the memory. In contrast to this, when the organic light emitting diode OLED is degraded, value "0010" may be stored in the memory. In this case, the controller 176 controls the current DAC 173 so that the degradation of the organic light emitting diode OLED can be compensated corresponding to the digital value.

The current DAC 173 sinks a current (e.g., a predetermined current) from the pixel 140. Here, a value of the electric current sunk in the current DAC 173 is determined under the control of the data driver 120 and the controller 176.

Figure 6:
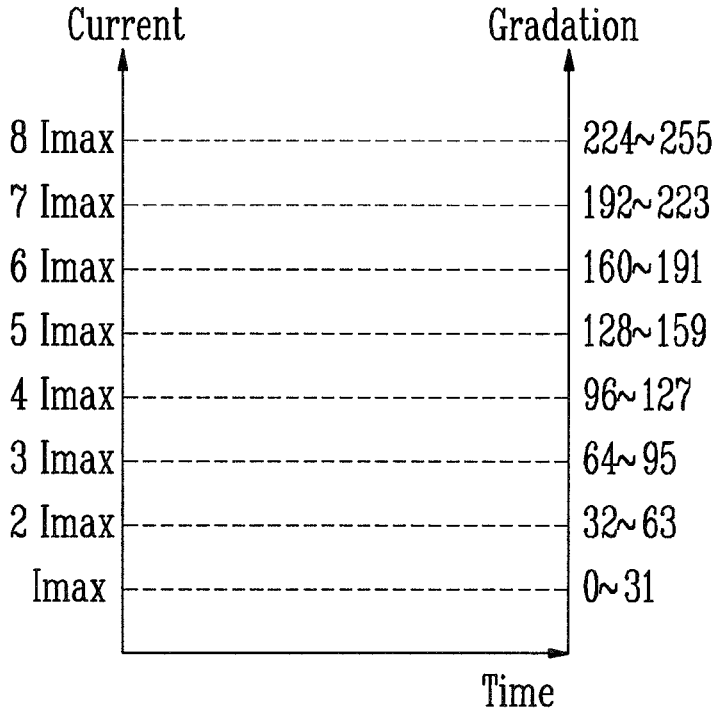
FIG. 6 is a chart showing a level of an electric current in the current DAC shown in FIG. 4.

In detail, in an exemplary embodiment of the present invention, the current DAC 173 sinks one among I currents (where I is a natural number) corresponding to data Data, namely, a gradation of the data as shown in FIG. 6. For example, for 8-bit image data with 256 gradation values as in FIG. 6, the current DAC 173 sinks one among 8 currents Imax to 8Imax corresponding to upper bits of the data Data. Here, after one among 8 currents Imax to 8Imax is sunk, an emission time of the pixels 140 is controlled to express a detailed gradation. For example, when a gradation of the data Data is set as "100", the current DAC 173 sinks 4Imax current, which corresponds to a gradation between 96-127. Further, an emission time of a pixel 140 in which the 4Imax current is sunk is controlled to express a gradation of "100". In this case, the 4Imax current is sunk using upper bits of the data Data, and an emission time is controlled using lower bits of the data Data.

Meanwhile, the current DAC 173 additionally sinks an electric current so that the degradation of the organic light emitting diode OLED may be compensated. For example, when a gradation of the data Data is set as "100", the current DAC 173 sinks $\alpha$+4Imax current. Here, a represents an added current to compensate for the degradation of the organic light emitting diode OLED. Further, in FIG. 6, Imax represents the least current sunk in the current DAC 173 corresponding to a bit of the data Data.

Figure 7:
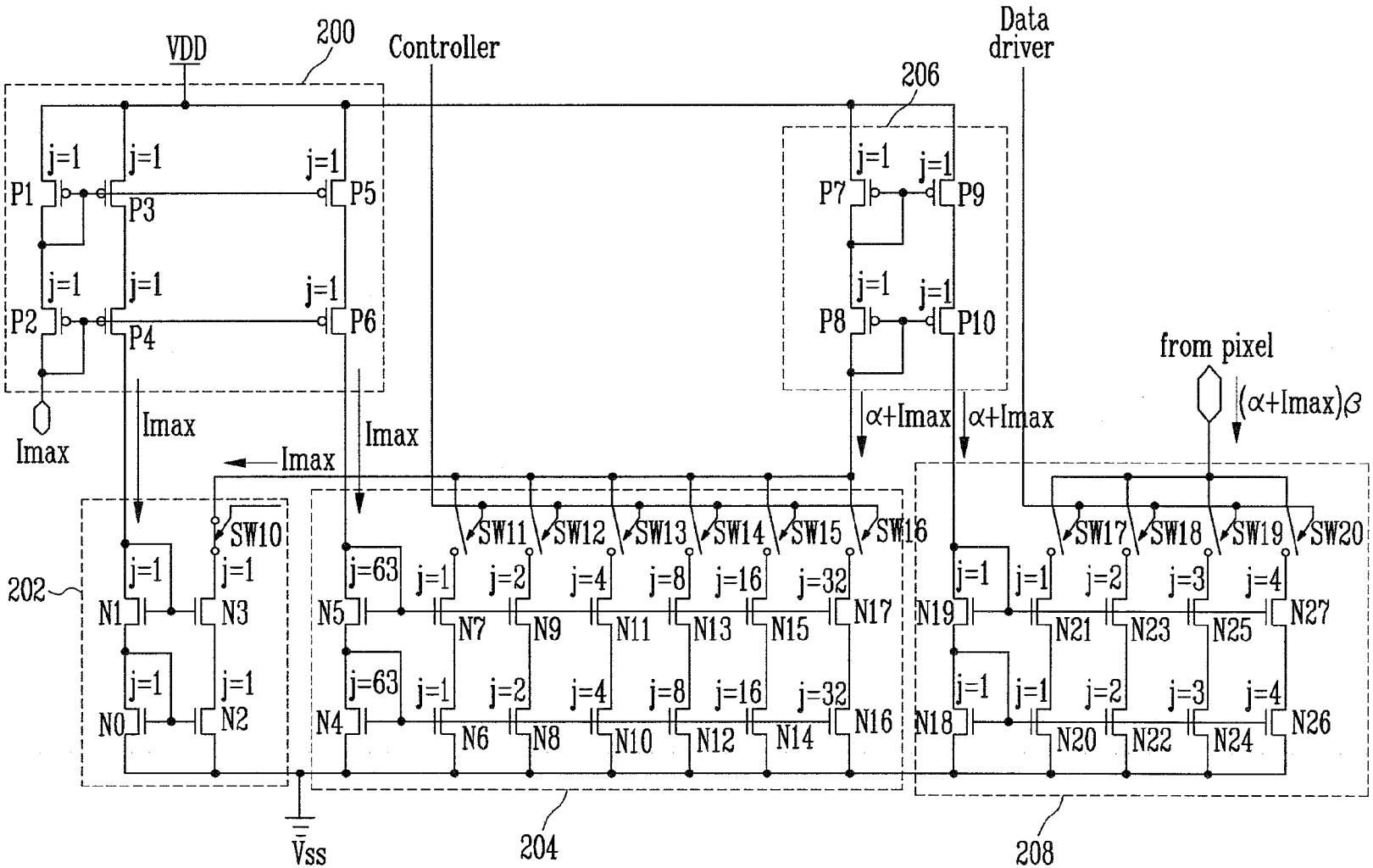
FIG. 7 is a schematic diagram showing a first exemplary embodiment of the current DAC shown in FIG. 4.

FIG. 7 is a schematic diagram showing a first exemplary embodiment of the current DAC 173 shown in FIG. 4. In FIG. 7, 'j' represents the number of transistors, and '$\beta$' represents an electric current selected by a gradation of the data Data. For example, in one embodiment, $\beta$ can be one selected from 1, 2, 3, 4, 5, 6, 7, and 8, as shown in FIG. 6.

With reference to FIG. 7, the current DAC 173 of the first exemplary embodiment of the present invention includes a first current generator 200, a first current sink unit 202, a second current sink unit 204, a second current generator 206, and a third current sink unit 208. The first current generator 200 generates Imax current. The first current sink unit 202 is coupled to the first current generator 200, and sinks the Imax current. The second current sink unit 204 is coupled to the current generator 200, and sinks a current. The second current generator 206 is coupled to the first current sink unit 202 and the second current sink unit 204, and generates $\alpha$+Imax current. The third current sink unit 208 is coupled to the second current generator 206, and sinks $\beta\times(\alpha+\text{Imax})$ current from the pixel 140.

The first current generator 200 generates Imax current. To do this, the first current generator 200 includes transistors P1 through P6. The P1 transistor and the P2 transistor are diode-connected, and channel widths thereof are set so that Imax current flows from a third power source VDD.

The P3 transistor and the P4 transistor are serially coupled between the third power source VDD and the first current sink unit 202. Here, the P3 transistor is coupled to the P1 transistor as a current mirror. The P4 transistor is coupled to the P2 transistor as a current mirror. The P3 and P4 transistors supply Imax current to the first current sink unit 202.

The P5 transistor and the P6 transistor are serially coupled between the third power source VDD and the second current sink unit 204. Here, the P5 transistor is coupled to the P1 transistor as a current mirror. The P6 transistor is coupled to the P2 transistor as a current mirror. The P5 and P6 transistors supply Imax current to the second current sink unit 204.

The first current sink unit 202 sinks Imax current from the second current generator 206. To do this, the first current sink unit 202 includes transistors N0 through N3. The N0 and N1 transistors are diode-connected between the P4 transistor of the first current generator 200 and a fourth power source VSS. The N0 and N1 transistors receive the Imax current from the first current generator 200 and supply it to the fourth source VSS.

The N2 and N3 transistors are serially coupled between the second current generator 206 and the fourth power source VSS. Here, the N3 transistor is coupled to the N1 transistor as a current mirror. The N2 transistor is coupled to the N0 transistor as a current mirror. Accordingly, the N2 and N3 transistors sink an electric current corresponding to Imax from the second current generator 206.

Meanwhile, a tenth switch SW10 is coupled between the N3 transistor and the second current generator 206. According to this exemplary embodiment, the tenth switch SW10 always maintains an on state. The tenth switch SW10 is used to match resistance with switches SW11 through SW16 included in the second current sink unit 204.

The second current sink unit 204 sinks a current from the second current generator 206. In detail, the second current sink unit 204 includes the N5 transistors and the N4 transistors, which are serially coupled between the first current generator 200 and the fourth power source VSS. Here, the N5 transistors are coupled to each other in parallel. For example, the N5 transistors comprise 63 transistors, which are coupled to each other in parallel. Accordingly, one sixty-third of the Imax current flows through each of 63 of the N5 transistors. In the same manner, the N4 transistors include 63 transistors, which are coupled to each other in parallel. Accordingly, one sixty-third of the Imax current flows through each of 63 of the N6 transistors. In practice, the number of the N5 transistors and the number of the N4 transistors can be variously set. However, the number of N5 and N4 transistors should be the same as the number of transistors N6 through N17, which are coupled to the switches SW11 through SW16.

Further, the second current sink unit 204 includes an eleventh switch SW11 through a sixteenth switch SW16, and a sixth transistor N6 through a seventeenth transistor N17. The eleventh switch SW11 through the sixteenth switch SW16 are coupled to the second current generator 206. The sixth transistor N6 through the seventeenth transistor N17 are coupled between each of the eleventh switch SW11 through the sixteenth switch SW16 and the fourth power source VSS.

Here, the number of transistors coupled to each of the eleventh switch SW11 through the sixteenth switch SW16 is increased at a rate of $2^k$ (k=0, 1, 2, 3, . . . ). In detail, one N7 transistor and one N6 transistor are serially coupled between the eleventh switch SW11 and the fourth power source VSS. The N7 transistor defines a current mirror with the N5 transistors. The N6 transistor defines a current mirror with the N4 transistors. Accordingly, when the eleventh switch SW11 is turned on, one sixty-third of the Imax current from the second current generator 206 is additionally sunk. In one embodiment, only the N7 transistor is coupled between the eleventh switch SW11 and the fourth power source VSS. (Namely, the N6 transistor is removed.) In this case, N4, N8, N10, N12, N14, N16, N2, and N0 transistors are also removed. In the present embodiment, however, transistors are serially coupled between the eleventh switch SW11 through the sixteenth switch SW16 and the fourth power source VSS for stability. However, the present invention is not limited thereto.

Two N9 transistors and two N8 transistors are serially coupled between the twelfth switch SW12 and the fourth power source VSS. (Here, the N9 transistors are coupled to each other in parallel, and the N8 transistors are coupled to each other in parallel.) The N9 transistors define a current mirror with the N5 transistors. The N8 transistors define a current mirror with the N4 transistors. Accordingly, when the twelfth switch SW12 is turned on, two sixty-thirds of the Imax current from the second current generator 206 is additionally sunk.

Four N11 transistors and four N10 transistors are serially coupled between the thirteenth switch SW13 and the fourth power source VSS. The N11 transistors define a current mirror with the N5 transistors. The N10 transistors define a current mirror with the N4 transistors. Accordingly, when the thirteenth switch SW13 is turned on, four sixty-thirds of the Imax current from the second current generator 206 is additionally sunk.

Eight N13 transistors and eight N12 transistors are serially coupled between the fourteenth switch SW14 and the fourth power source VSS. The N13 transistors define a current mirror with the N5 transistors. The N12 transistors define a current mirror with the N4 transistors. Accordingly, when the fourteenth switch SW14 is turned on, eight sixty-thirds of the Imax current from the second current generator 206 is additionally sunk.

Sixteen N15 transistors and sixteen N14 transistors are serially coupled between the fifteenth switch SW15 and the fourth power source VSS. The N15 transistors define a current mirror with the N5 transistors. The N14 transistors define a current mirror with the N4 transistors. Accordingly, when the fifteenth switch SW15 is turned on, sixteen sixty-thirds of the Imax current from the second current generator 206 is additionally sunk.

Thirty-two N17 transistors and thirty-two N16 transistors are serially coupled between the sixteenth switch SW16 and the fourth power source VSS. The N17 transistors define a current mirror with the N5 transistors. The N16 transistors define a current mirror with the N4 transistors. Accordingly, when the sixteenth switch SW16 is turned on, thirty-two sixty-thirds of the Imax current from the second current generator 206 is additionally sunk.

Meanwhile, the eleventh switch SW11 through the sixteenth switch SW16 are turned on/off under the control of the controller 176. The controller 176 controls the eleventh switch SW11 through the sixteenth switch SW16 so that a current to compensate for degradation of the organic light emitting diode OLED of the pixel 140 can flow from the second current generator 206.

The second current generator 206 provides α+Imax current to the third current sink unit 208. To do this, the second current generator 206 includes transistors P7 through P10. The P7 transistor is coupled to the third power source VDD. The P8 transistor is coupled between the first current sink unit 202 and the second current sink unit 204. The P7 and P8 transistors are serially coupled to be diode-connected to each other. Accordingly, the α+Imax current sunk from the first current sink unit 202 and the second current sink unit 204 flows through the P7 and P8 transistors.

The P9 and P10 transistors are serially coupled to each other between the third power source VDD and the third current sink unit 208. Here the P9 transistor is coupled to the P7 transistor as a current mirror. Further, the P10 transistor is coupled to the P8 transistor as a current mirror. The P9 and P10 transistors supply the α+Imax current to the third current sink unit 208.

The third current sink unit 208 sinks the β×(α+Imax) current from the pixel 140. The third current sink unit 208 includes transistors N19 and N18, which are serially coupled with each other between the second current generator 206 and the fourth power source VSS. The N19 and N18 transistors are diode-connected to receive the α+Imax current from the second current generator 206 and supply it to the fourth power source VSS.

Further, the third current sink unit 208 includes a seventeenth switch SW17 through a twentieth switch SW20, and a twentieth transistor N20 through a twenty seventh transistor N27. The seventeenth switch SW17 through the twentieth switch SW20 are coupled to the switching unit 171. The twentieth transistor N20 through the twenty-seventh transistor N27 are coupled between each of the seventeenth switch SW17 through the twentieth switch SW20 and the fourth power source VSS.

Here, the number of transistors coupled to each of the seventeenth switch SW17 through the twentieth switch SW20 is set to flow a desired β current. For example, one N21 transistor and one N20 transistor are formed between the seventeenth switch SW17 and the fourth power source VSS. The N21 transistor defines a current mirror with the N19 transistor. Further, the N20 transistor defines a current mirror with the N18 transistor. Accordingly, when the seventeenth switch SW17 is turned on, the α+Imax current is sunk from the pixel 140. In one embodiment, only the N21 transistor is formed between the seventeenth switch SW17 and the fourth power source VSS. (Namely, the N20 transistor is removed.) In this case, N18, N20, N22, N24, and N26 transistors are also removed. In the present embodiment, however, transistors are serially coupled between the seventeenth switch SW17 through the twentieth switch SW20 and the fourth power source VSS for stability. However, the present invention is not limited thereto.

In the same manner, two N23 transistors and two N22 transistors are serially coupled between the eighteenth switch SW18 and the fourth power source VSS. Accordingly, when the eighteenth switch SW18 is turned on, 2×(α+Imax) current is sunk from the pixel 140. Three N25 transistors and three N24 transistors are serially coupled between the nineteenth switch SW19 and the fourth power source VSS. Accordingly, when the nineteenth switch SW19 is turned on, 3×(α+Imax) current is sunk from the pixel 140. Four N27 transistors and four N26 transistors are serially coupled between the twentieth switch SW20 and the fourth power source VSS. Accordingly, when the twentieth switch SW20 is turned on, 4×(α+Imax) current is sunk from the pixel 140. Here, FIG. 7 shows four switches SW17 to SW20 included in the third current sink unit 208. However, the present invention is not limited thereto. In practice, the number of the switches SW17 to SW20 included in the third current sink unit 208 can be variously set so that a desired β current can flow.

According to an exemplary embodiment, the seventeenth switch SW17 to the twentieth switch SW20 are turned on/off according to the upper bits of data Data supplied from the data driver 120. The data driver 120 controls turning on/off of the seventeenth switch SW17 to the twentieth switch SW20 corresponding to upper bits of data Data to sink β×(α+Imax) current from the pixel 140 corresponding to a gradation.

Figure 8:
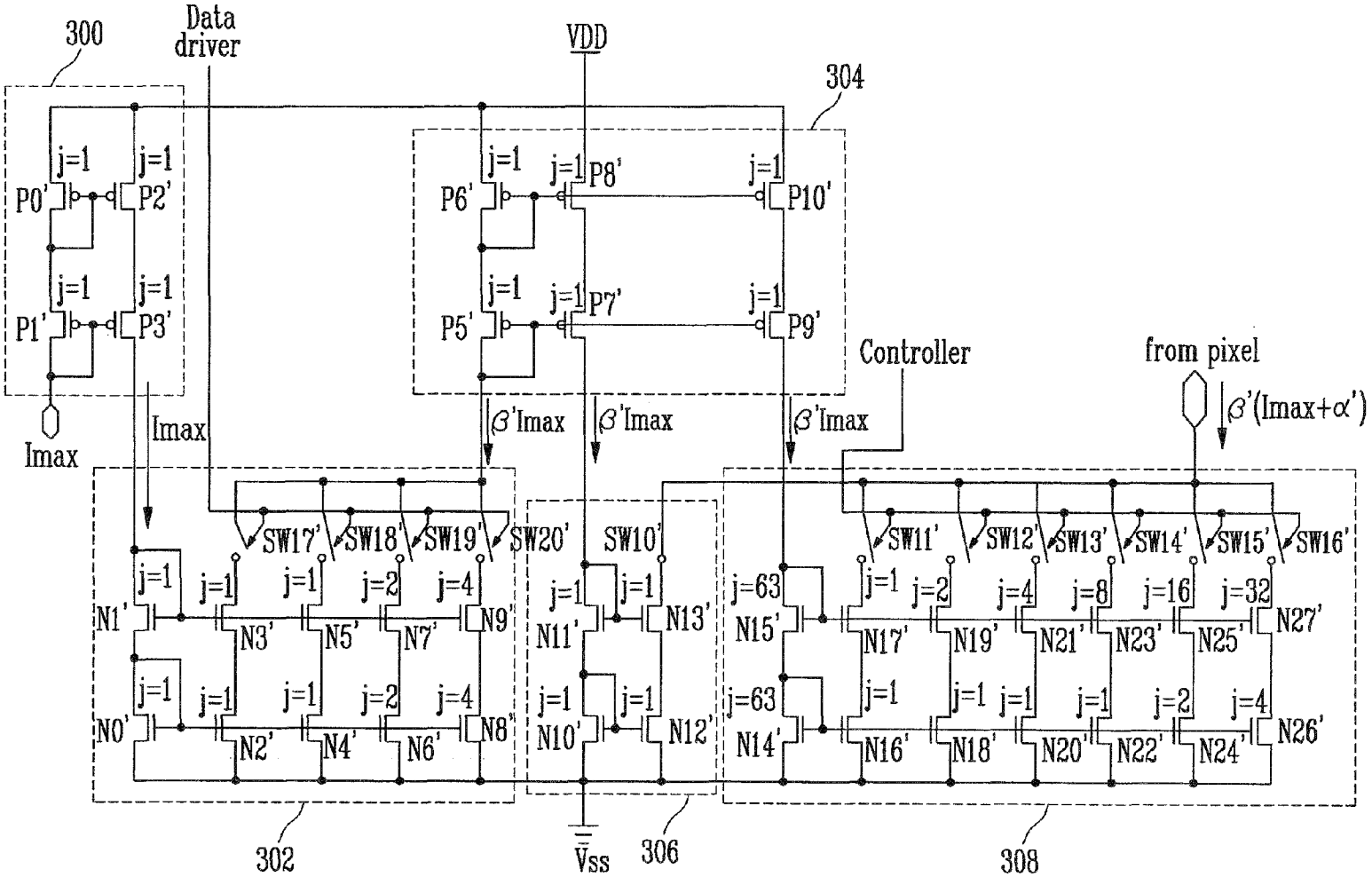
FIG. 8 is a schematic diagram showing a second exemplary embodiment of the current DAC shown in FIG. 4.

FIG. 8 is a view showing a second exemplary embodiment of the current DAC shown in FIG. 4. In FIG. 8, α' current to compensate for a degradation of the organic light emitting diode is generated after a generation of β'×Imax current to emit a gradation, which is different from FIG. 7.

With reference to FIG. 8, the second exemplary embodiment of the current DAC 173 in the present invention includes a first current generator 300, a first current sink unit 302, a second current generator 304, a second current sink unit 306, and a third current sink unit 308. The first current generator 300 generates Imax current. The first current sink unit 302 is coupled to the first current generator 300, and sinks β'×Imax current. The second current generator 304 is coupled to the first current sink unit 302, and generates the β'×Imax current. The second current sink unit 306 is coupled to the second current generator 304, and sinks β'×Imax current from the pixel 140. The third current sink unit 308 is coupled with the second current generator 304, and sinks α' current from the pixel 140.

The first current generator 300 generates Imax current. To do this, the first current generator 300 includes P0' through P3' transistors. The P0' transistor and the P3' transistor are diode-connected, and channel widths thereof are set so that Imax current can flow from a third power source VDD.

The P2' transistor and the P3' transistor are serially coupled between the third power source VDD and the first current sink unit 302. Here, the P2' transistor is coupled to the P0' transistor as a current mirror. The P3' transistor is coupled to the P1' transistor as a current mirror. The P2' and P3' transistors supply Imax current to the first current sink unit 302.

The first current sink unit 302 sinks β'×Imax current from the second current generator 304 while receiving Imax current from the first current generator 300. To do this, the first current sink unit 302 includes N1' and N0' transistors. The N1' and N0' transistors are diode-connected between the P3 transistor of the first current generator 300 and a fourth power source VSS. The N1' and N0' transistors are diode-connected and receive the Imax current from the first current generator 300 and supply it to the fourth power source VSS.

Further, the first current sink unit 302 includes a seventeenth switch SW17' through a twentieth switch SW20', and a second transistor N2' through a ninth transistor N9'. The seventeenth switch SW17' through the twentieth switch SW20' are coupled to the second current generator 304. The second transistor N2' through the ninth transistor N9' are coupled between each of the seventeenth switch SW17' through the twentieth switch SW20' and the fourth power source VSS.

Here, the number of transistors is set to be coupled to each of the seventeenth switch SW17' through the twentieth switch SW20' so that β'×Imax current can be efficiently sunk. For example, the number of transistors set to be coupled to each of the seventeenth switch SW17' through the twentieth switch SW20' can be increased at a rate of $2^h$ (h=0, 1, 2, . . . ). In detail, one N2' transistor and one N3' transistor are formed between the seventeenth switch SW17' and the fourth power source VSS. The N3' transistor defines a current mirror with the N1' transistor. The N2' transistor defines a current mirror with the N0' transistor. Accordingly, when the seventeenth switch SW17' is turned on, the Imax current is sunk from the second current generator 304. In one embodiment, only the N3' transistor can be formed between the seventeenth switch SW17' and the fourth power source VSS. (Namely, the N2' transistor is removed.) In this case, N0', N4', N6', and N8' transistors are also removed. In the present embodiment, however, transistors are serially coupled between the seventeenth switch SW17' through the twentieth switch SW20' and the fourth power source VSS for stability. However, the present invention is not limited thereto.

In the same manner, one N5' transistor and one N4' transistor are formed between an eighteenth switch SW18' and the fourth power source VSS. Accordingly, when the eighteenth switch SW18' is turned on, the Imax current is sunk from the second current generator 304. Two N7' transistors and two N6' transistors are formed between a nineteenth switch SW19' and the fourth power source VSS. Accordingly, when the nineteenth switch SW19' is turned on, the 2×Imax current is sunk from the second current generator 304. Four N9' transistors and four N8' transistors are formed between a twentieth switch SW20' and the fourth power source VSS. Accordingly, when the twentieth switch SW20' is turned on, the 4×Imax current is sunk from the second current generator 304.

Meanwhile, the seventeenth switch SW17' to the twentieth switch SW20' are turned on/off according to upper bits of data Data supplied from the data driver 120. The data driver 120 controls turning on/off of the seventeenth switch SW17' to the twentieth switch SW20' corresponding to upper bits of data Data to sink β'×Imax current from the second current generator 304 corresponding to a gradation.

The second current generator 304 provides the β'×Imax current to the second current sink unit 306 and the third current sink unit 308. To do this, the second current generator 304 includes transistors P5' through P10'.

The P6' transistor is coupled to the third power source VDD. The P5' transistor is coupled to the first current sink unit 302. The P6' and P5' are serially diode-connected to each other. The β'×Imax current sunk by the first current sink unit 302 flows through the P6' and P5' transistors.

P8' and P7' transistors are serially coupled between the third power source VDD and the second current sink unit 306. The P8' transistor is coupled to the P6' transistor as a current mirror. The P7' transistor is coupled to the P5' transistor as a current mirror. The P8' and P7' transistors provide the β'×Imax current to the second current sink unit 306.

P10' and P9' transistors are serially coupled between the third power source VDD and the third current sink unit 308. The P10' transistor is coupled to the P6' transistor as a current mirror. The P9' transistor is coupled to the P5' transistor as a current mirror. The P10' and P9' transistors provide the β'×Imax current to the third current sink unit 308.

The second current sink unit 306 sinks the β'×Imax current from the pixel 140 through the switch unit 171 and the feedback line Fm. So as to do this, the second current sink unit 306 includes N10' through N13' transistors. The N10' and N11' transistors are serially diode-connected between the P7' transistor of the second current generator 304 and the fourth power source VSS. The N10' and N11' transistors are serially diode-connected and provide the β'×Imax current from the second current generator 304 to the fourth power source VSS.

N13' and N12' transistors are coupled between the switching unit 171 and the fourth power source VSS. The N13' transistor is coupled to the N11' transistor as a current mirror. The N12' transistor is coupled to the N10' transistor as a current mirror. The N13' and N12' transistors sink the β'×Imax current from the pixel 140.

Meanwhile, a tenth switch SW10' is installed between the N13' transistor and the switching unit 171. The tenth switch unit SW10' always maintains a turned on state. The tenth switch SW10' is used to match resistance with switches SW11' through SW16' included in the third current sink unit 308.

The third current sink unit 308 sinks α' current from the pixel 140. In detail, the third current sink unit 308 includes N15' transistors and N14' transistors serially coupled between the second current generator 304 and the fourth power source VSS. Here, the N15' transistors are coupled to each other in parallel. For example, the N15' transistors include 63 transistors, which are coupled to each other in parallel. Accordingly, one sixty-third of the β'×Imax current flows through each of 63 N15' transistors. In the same manner, the N14' transistors include 63 transistors, which are coupled to each other in parallel. Accordingly, one sixty-third of the β'×Imax current flows through 63 N14' transistors. In practice, the number of the N15' transistors and the number of the N14' transistors can be variously set. However, the same number of N15' and N14' transistors should be set by the corresponding number of transistors N16' through N27', which are coupled to the switches SW11' through SW16'.

Further, the third current sink unit 308 includes an eleventh switch SW11' through a sixteenth switch SW16', and a sixteenth transistor N16' through a twenty-seventh transistor N27'. The eleventh switch SW11' through the sixteenth switch SW16' are coupled to the switching unit 171. The sixteenth transistor N16' through the twenty seventh transistor N27' are coupled between each of the eleventh switch SW11' through the sixteenth switch SW16' and the fourth power source VSS.

Here, the number of transistors coupled to each of the eleventh switch SW11' through the sixteenth switch SW16' is set to be increased in a rate of $2^k$ (k=0, 1, 2, . . . ). In detail, one N17' transistor and one N16' transistor are serially coupled between the eleventh switch SW11' and the fourth power source VSS. The N17' transistor defines a current mirror with the N15' transistors. The N16' transistor defines a current mirror with the N14' transistors. Accordingly, when the eleventh switch SW11' is turned on, one sixty-third of the β'×Imax current from the pixel 140 is additionally sunk. In one embodiment, only the N17' transistor is formed between the eleventh switch SW11' and the fourth power source VSS. (Namely, the N16' transistor is removed.) In this case, N14', N16', N18', N20', N22', N24', and N26' transistors are also removed. In the present embodiment, however, transistors are serially coupled between the eleventh switch SW11' through the sixteenth switch SW16' and the fourth power source VSS for stability. However, the present invention is not limited thereto.

Two N19' transistors and two N18' transistors are serially coupled between the twelfth switch SW12' and the fourth power source VSS. (Here, the N19' transistors are coupled to each other in parallel, and the N18' transistors are coupled to each other in parallel.) The N19' transistors define a current mirror with the N15' transistors. The N18' transistors define a current mirror with the N14' transistors. Accordingly, when the twelfth switch SW12 is turned on, two sixty-thirds of the β'×Imax current from the pixel 140 is additionally sunk.

Four N21' transistors and four N20' transistors are serially coupled between the thirteenth switch SW13' and the fourth power source VSS. The N21' transistors define a current mirror with the N15' transistors. The N20' transistors define a current mirror with the N14' transistors. Accordingly, when the thirteenth switch SW13' is turned on, four sixty-thirds of the β'×Imax current from the pixel 140 is additionally sunk.

Eight N23' transistors and eight N22' transistors are serially coupled between the fourteenth switch SW14' and the fourth power source VSS. The N23' transistors define a current mirror with the N15' transistors. The N22' transistors define a current mirror with the N14' transistors. Accordingly, when the fourteenth switch SW14' is turned on, eight sixty-thirds of the β'×Imax current from the pixel 140 is additionally sunk.

Sixteen N25' transistors and sixteen N24' transistors are serially coupled between the fifteenth switch SW15' and the fourth power source VSS. The N25' transistors define a current mirror with the N15' transistors. The N24' transistors define a current mirror with the N14' transistors. Accordingly, when the fifteenth switch SW15' is turned on, sixteen sixty-thirds of the β'×Imax current from the pixel 140 is additionally sunk.

Thirty two N27' transistors and thirty two N26' transistors are serially coupled between the sixteenth switch SW16' and the fourth power source VSS. The N27' transistors define a current mirror with the N15' transistors. The N26' transistors define a current mirror with the N14' transistors. Accordingly, when the sixteenth switch SW16' is turned on, thirty-two sixty-thirds of the β'×Imax current from the pixel 140 is additionally sunk.

Meanwhile, the eleventh switch SW11' through the sixteenth switch SW16' are turned on/off under the control of the controller 176. The controller 176 controls the eleventh switch SW11' through the sixteenth switch SW16' to flow α' current capable of compensating degradation information of the organic light emitting diode OLED.

Figure 9:
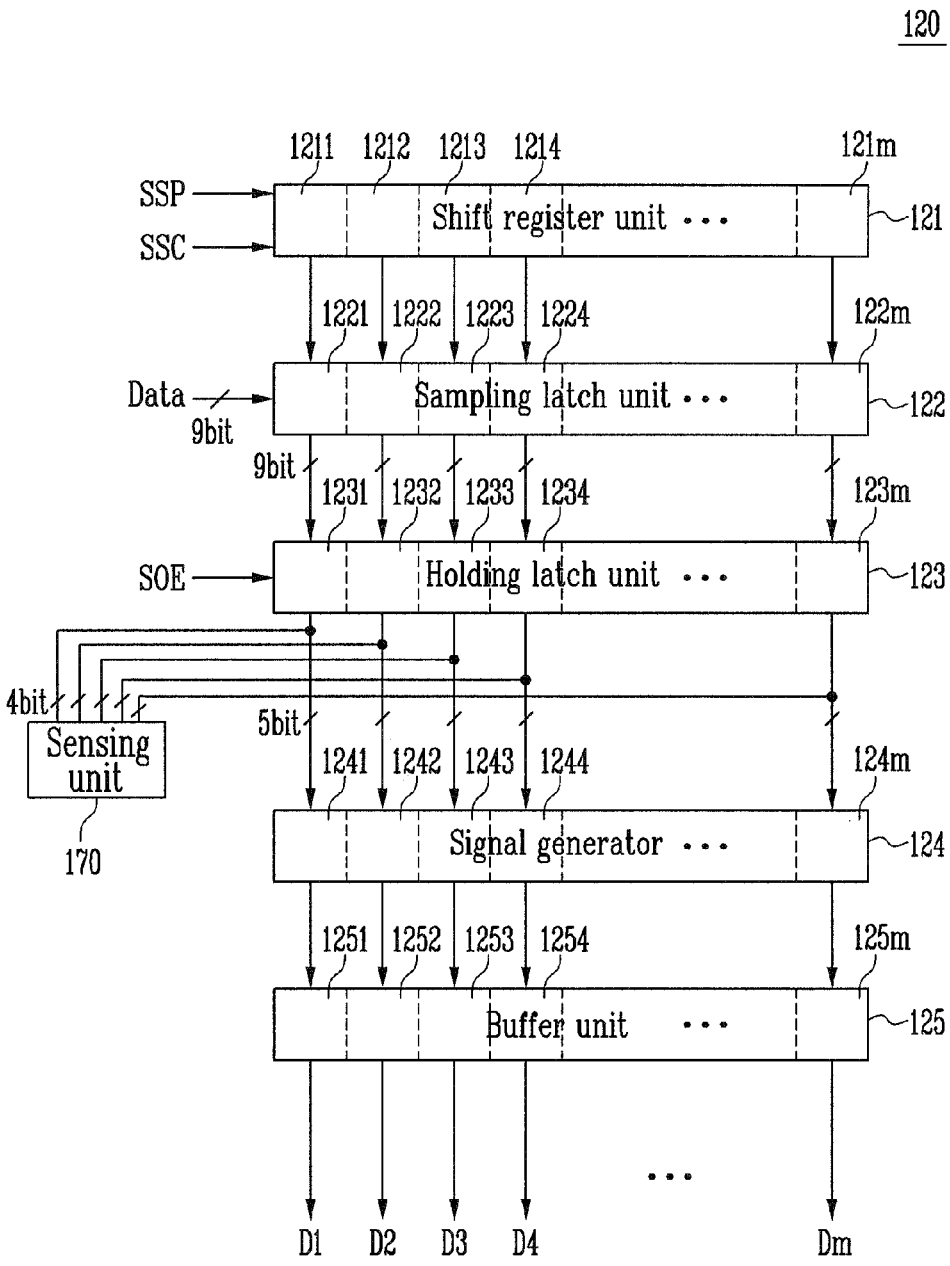
FIG. 9 is a schematic block diagram showing the data driver shown in FIG. 2.

FIG. 9 is a view showing an exemplary embodiment of the data driver 120 shown in FIG. 2.

With reference to FIG. 9, the data driver 120 includes a shift register unit 121, a sampling latch unit 122, a holding latch unit 123, a signal generator 124, and a buffer unit 125.

The shift register unit 121 receives a source start pulse SSP and a source shift clock SSC from a timing controller 150. When the shift register unit 121 receives a source start pulse SSP and a source shift clock SSC, it sequentially sends m sampling signals while shifting the source start pulse SSP every period of the source shift clock SSC. So as to do this, the shift register unit 121 includes m shift registers 1211 through 121*m*.

The sampling latch unit 122 sequentially stores data Data from the timing controller 150 in response to the sampling signals, which are sequentially supplied from the shift register unit 121. In order to do this, the sampling latch unit 122 includes m sampling latches 1221 through 122*m* so as to store m data Data. In the illustrated exemplary embodiment of FIG. 9, the data Data is 9 bits wide.

The holding latch unit 123 receives a source output enable signal SOE from the timing controller 150. When the holding latch unit 123 receives the source output enable signal SOE, it receives and stores data Data from the sampling latch unit 122. Further, the holding latch unit 123 supplies the data Data stored therein to a sensing unit 170 and the signal generator 124. To do this, the holding latch unit 123 includes m holding latches 1231 through 123*m*.

For example, when the data Data has 9 bits, the holding latch unit 123 can supply the upper 4 bits to the sensing unit 170, and supply the lower 5 bits to the signal generator 124. Here, each of holding latches 1231 through 123*m* supply upper bits to current DAC 173, which are coupled to respective channels.

The signal generator 124 receives lower bits of the data Data from the holding latch unit 123, and generates m data signals corresponding to the received data Data. In order to do this, the signal generator 124 includes m pulse generators 1241 through 124*m*. That is, the signal generator 124 generates m data signals using the pulse generators 1241 through 124*m* coupled to every channel, and provides the m data signals to the buffer unit 125.

The buffer unit 125 provides the m data signals from the signal generator 124 to m data lines D1 through Dm. To do this, the buffer unit 125 includes m buffers 1251 through 125*m*.

Figure 10A:
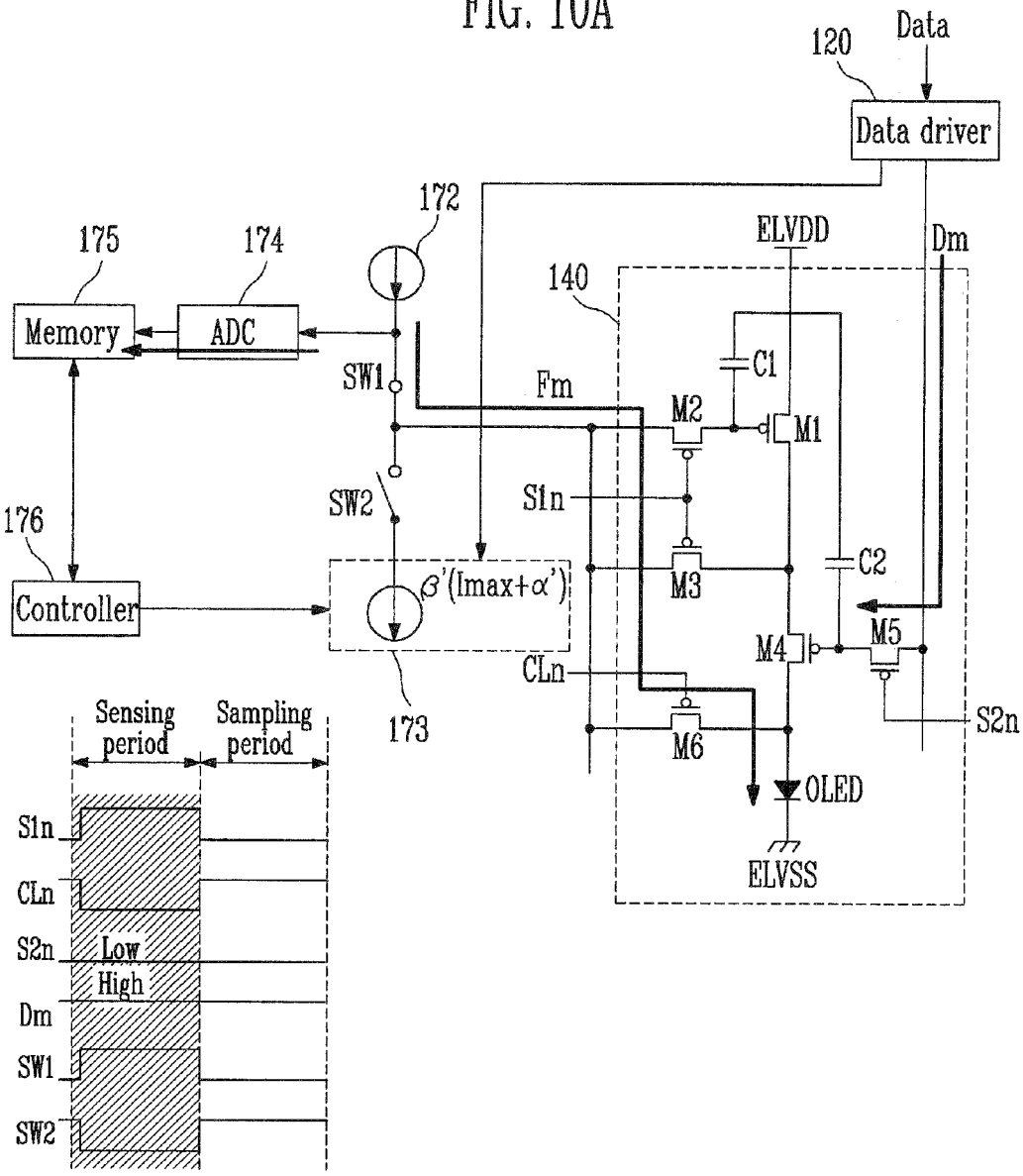
FIG. 10A and FIG. 10B are schematic block diagrams illustrating an operation procedure of the sensing unit.
Figure 10B:
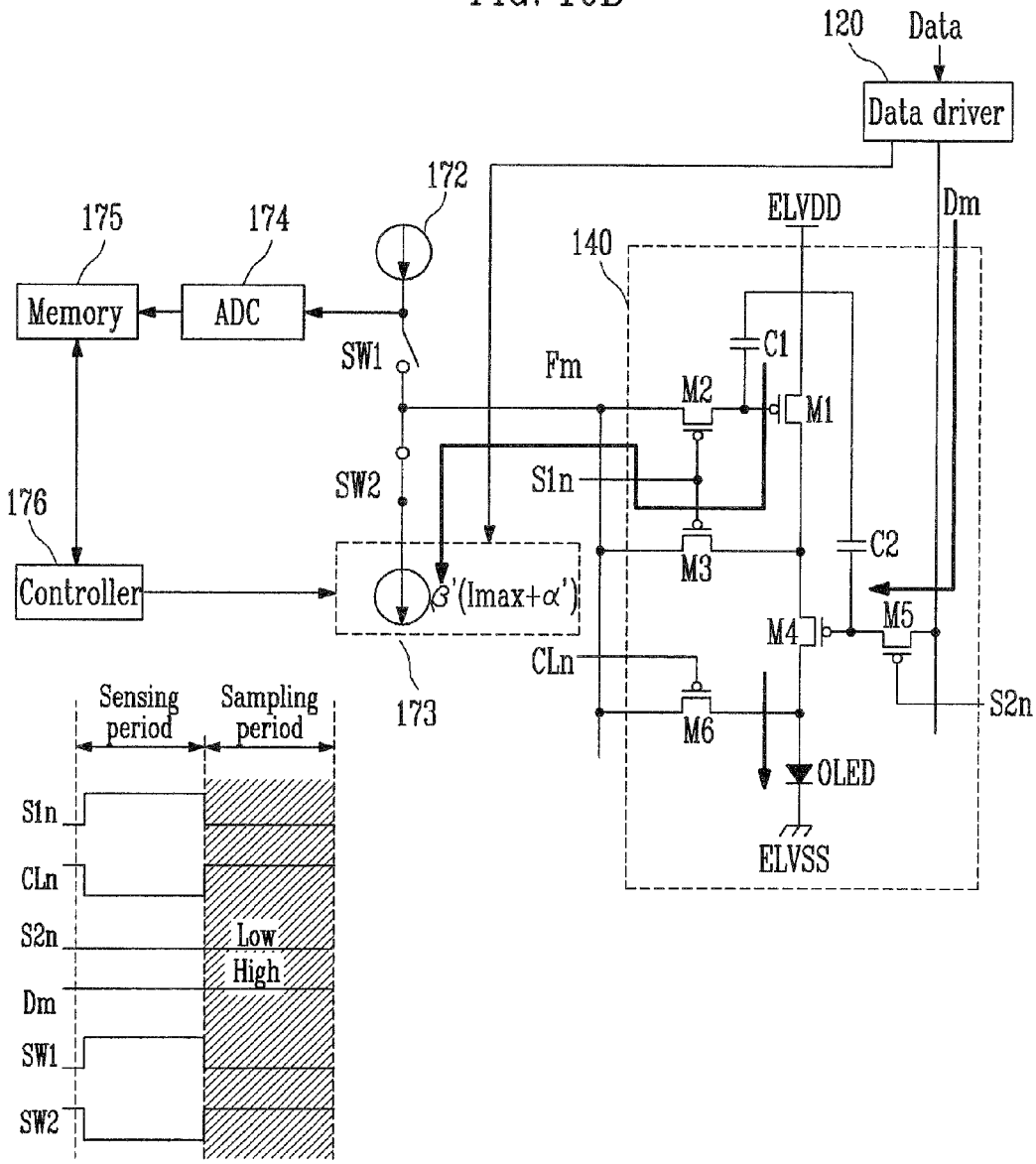

FIG. 10A and FIG. 10B are schematic block diagrams illustrating a method for driving the organic light emitting display according to an exemplary embodiment of the present invention. For convenience of description, FIG. 10A and FIG. 10B show a pixel coupled to an m-th data line Dm, an m-th feedback line Fm, an n-th first scan line S1*n*, an n-th second scan line S2*n*, and an n-th control line CLn.

Referring to FIG. 10A and FIG. 10B, a second scan signal is supplied to the second scan line S2*n*, and a control signal is supplied to the control line CLn during the sensing period. When the first switch SW1 is turned on during the sensing period, the second data signal (causing the pixel 140 not to emit light) is supplied to the data line Dm.

When the second scan signal is supplied to the second scan line S2*n*, the fifth transistor M5 is turned on. When the fifth transistor M5 is turned on, the second capacitor C2 is charged with a voltage corresponding to the second data signal supplied to the data line Dm. Accordingly, the fourth transistor M4 maintains a turned off state during the sensing period.

When the control signal is supplied to the control line CLn, the sixth transistor M6 is turned on. At this time, because the first switch SW1 is turned on, an electric current from the current source unit 172 is provided to the organic light emitting diode OLED through the feedback line Fm and the sixth transistor M6. Further, a voltage (e.g., a predetermined voltage) corresponding to an electric current supplied from the current source unit 172 is applied to the organic light emitting diode OLED. The ADC 174 converts the voltage applied the organic light emitting diode OLED to a digital value, and stores the digital value in the memory 175.

In practice, during the sensing period, an exemplary embodiment of the aforementioned procedure repeats to store digital values of all the pixels 140 in the memory 175.

Meanwhile, when the ADC 174 is coupled to all channels in common, a first switch SW1 is sequentially turned on, which is coupled to every channel. In detail, a control signal is sequentially supplied in horizontal lines. For example, a control signal is supplied to a j-th control line CLj, and a sixth transistor M6 (included in each of the pixels 140 coupled to the j-th horizontal line) is turned on. Here, 'j' is a natural number. Next, the first switches SW1 coupled to the first feedback line F1 to the m-th feedback line Fm are sequentially turned-on. Accordingly, a digital value of the pixel 140 coupled to the first feedback line F1 to a digital value of the pixel coupled to the m-th feedback line Fm are sequentially stored in the memory 175.

Subsequently, during the sampling period, as shown in FIG. 10B, a first scan signal is supplied to the first scan line S1*n*, and a second scan signal is supplied to the second scan line S2*n*. Further, during the sampling period, the second switch SW2 is turned on and concurrently the second data signal is supplied to the data line Dm.

When the second scan signal is supplied to the second scan line S2*n*, the fifth transistor M5 is turned on. When the fifth transistor M5 is turned on, the second capacitor C2 is charged with a voltage corresponding to the second data signal supplied to the data line Dm. Accordingly, the fourth transistor M4 maintains a turned off state during the sampling period.

When the first scan signal is supplied to the first scan line S1*n*, the second transistor M2 and the third transistor M3 are turned on. Accordingly, the feedback line Fm and a gate electrode and a second electrode of the first transistor M1 are electrically coupled to each other.

Meanwhile, the controller 176 extracts a digital value from the memory 175 corresponding to the appropriate pixel 140 that is coupled to the feedback line Fm.

Next, as described above with reference to FIGS. 7-8, the controller 176 controls the turning on/off of the eleventh switch SW11 (or SW11') through the sixteenth switch SW16 (or SW16') so that degradation of the pixel 140 may be compensated. Further, during the sampling period, the data driver 120 controls the current DAC 173 so that a voltage corresponding to a gradation of data Data may be sunk.

Accordingly, the degradation of the organic light emitting diode OLED is compensated and, referring to the exemplary embodiment illustrated in FIG. 7, $\beta\times(\alpha+Imax)$ current corresponding to a gradation of the data Data is sunk in the current DAC 173. The $\beta\times(\alpha+Imax)$ current sunk in the current DAC 173 is provided to the current DAC 173 through a first power source ELVDD, the first transistor M1, the third transistor M3, the feedback line Fm, and the second switch SW2. Accordingly, a voltage corresponding to the $\beta\times(\alpha+Imax)$ current is applied to a gate electrode of the first transistor M1, and the first capacitor C1 is charged with the voltage.

In practice, while the aforementioned operation repeats during the sampling period, each capacitor C1 of all the pixels 140 is charged with a voltage (e.g., a predetermined voltage). In detail, during the sampling period, a first scan signal is sequentially supplied to the first scan lines S11 to S1*n*, and a second scan signal is sequentially supplied to the second scan lines S21 to S2*n*.

Here, the controller 176 controls the current DAC 173 coupled to every channel to compensate for the degradation of the organic light emitting diode OLED and to sink an electric current corresponding to a gradation of the data Data from each pixel 140.

Figure 11:
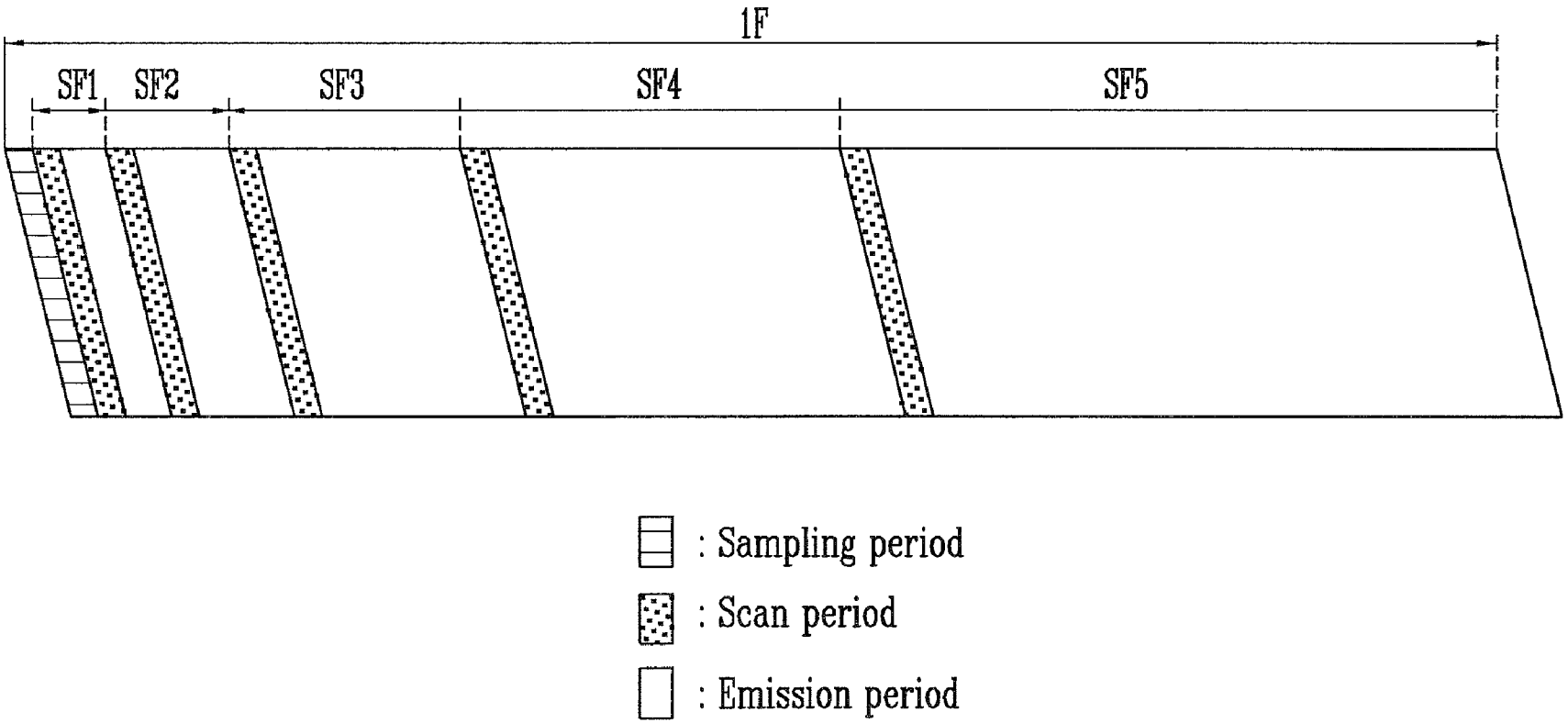
FIG. 11 is a diagram showing one frame which is utilized in the present invention.

FIG. 11 is a diagram showing one frame utilized in an exemplary embodiment of the present invention. With reference to FIG. 11, each frame has a sampling period and a plurality of sub frames SF1 through SF5. The sampling period occurs prior to the sub frames SF1 through SF5, and the first capacitor C1 included in each pixel 140 is charged with a voltage (e.g., a predetermined voltage) during the sampling period. Here, the voltage charged in the first capacitor C1 is differently set according to the gradation of the data Data. Also, the voltage charged in the first capacitor C1 is set capable of compensating the degradation of the organic light emitting diode OLED.

The sub frames SF1 through SF5 each include a scan period and an emission period. During the scan period, a second scan signal is sequentially supplied to second scan lines S21 through S2*n*. Further, a data signal is supplied to data lines D1 through Dm synchronously with the second scan signal. Accordingly, the second capacitor C2 included in each pixel 140 is charged with a voltage corresponding to a first data signal or a second data signal.

During the emission period, the fourth transistor M4 is turned on or turned off according to a voltage charged in the second capacitor C2. When the fourth transistor M4 is turned off, the pixel 140 is set in a non-emission state during a corresponding sub frame period. When the fourth transistor M4 is turned on, an electric current corresponding to the voltage charged in the first capacitor C1 is driven by the first transistor M1 to the organic light emitting diode OLED, so that the organic light emitting diode OLED is set in an emission state.

Meanwhile, as shown in FIG. 6, because the voltage charged in the first capacitor C1 is a voltage corresponding to a partial gradation of the data Data, a minute gradation is expressed using an emission time period. Further, since the voltage charged in the first capacitor C1 is set capable of compensating the degradation of the organic light emitting diode OLED, light of desired luminance may be generated. Moreover, because the first capacitor C1 is charged with a voltage corresponding to the sunk current through the first transistor M1, images of uniform luminance can be displayed regardless of nonuniformity in a threshold voltage and a mobility deviation of the first transistor M1.

As is seen from the foregoing description, in the organic light emitting display and a method for driving the same, a voltage applied to the organic light emitting diode is converted to a digital value and the digital value is stored in a memory while supplying an electric current to the organic light emitting diode. Next, an amount of an electric current sunk from a pixel is adjusted corresponding to the stored digital value in the memory so that degradation of the organic light emitting diode may be compensated. Accordingly, the degradation of the organic light emitting diode is compensated, so that images of desired luminance can be displayed. In addition, in the present invention, since an electric current sunk corresponding to a gradation (bit value) of data is divided into plural currents, a gradation expression performance can be enhanced.

Although exemplary embodiments of the present invention have been shown and described, it would be appreciated by those skilled in the art that changes might be made in these embodiments without departing from the principles and spirit of the invention, the scope of which is defined in the claims and their equivalents.

What is claimed is:

1. An organic light emitting display comprising:

a plurality of pixels, each pixel comprising an organic light emitting diode and a pixel circuit for controlling a supply of an electric current to the organic light emitting diode; and a sensing unit for supplying a first current to the organic light emitting diode in each of the pixels and converting a voltage applied to the organic light emitting diode to a digital value during a sensing period, and for sinking a second current from the pixel corresponding to the digital value to compensate for a degradation of the organic light emitting diode during a sampling period, wherein the second current is a function of a selected current value among I current values corresponding to a gradation of data, and a compensation current for compensating for the degradation of the organic light emitting diode, wherein I is a natural number.

2. The organic light emitting display as claimed in claim 1, wherein the sensing unit comprises:

a current source unit for supplying the first current;

a current digital-analog converter for sinking the second current;

a switching unit for selectively coupling the current source unit and the current digital-analog converter to a feedback line among a plurality of feedback lines, wherein each feedback line is coupled to at least one pixel among the plurality of pixels;

an analog-digital converter coupled to the current source unit for converting a voltage applied to the organic light emitting diode to the digital value;

a memory for storing the digital value; and a controller for controlling the current digital-analog converter so that the degradation of the organic light emitting diode is compensated corresponding to the digital value stored in the memory.

3. The organic light emitting display as claimed in claim 2, wherein the sensing unit further comprises a plurality of channels, each channel coupled to a respective one of the feedback lines, and each channel including the current source unit, the switching unit, and the current digital-analog converter.

4. The organic light emitting display as claimed in claim 2, wherein the switching unit comprises:

a first switch between the feedback line and the current source unit; and a second switch between the feedback line and the current digital-analog converter.

5. The organic light emitting display as claimed in claim 4, wherein the first switch is turned on during the sensing period, and the second switch is turned on during the sampling period.

6. The organic light emitting display as claimed in claim 2, wherein the current digital-analog converter comprises:

a first current generator for generating a third current and a fourth current corresponding to a smallest gradation, among the I current values divided corresponding to the gradation of the data;

a first current sink unit for sinking a fifth current corresponding to the third current supplied by the first current generator;

a second current sink unit for sinking a sixth current, wherein the sixth current is the compensation current, the sixth current corresponding to the fourth current supplied by the first current generator, and for compensating for the degradation of the organic light emitting diode;

a second current generator for generating a seventh current corresponding to a sum of the fifth current and the sixth current sunk by the first current sink unit and the second current sink unit, respectively; and a third current sink unit for sinking the second current from the feedback line, the second current corresponding to the seventh current multiplied a factor of β (β is a natural number), β corresponding to the gradation of the data.

7. The organic light emitting display as claimed in claim 6, wherein the first current sink unit comprises:

at least one first transistor being diode-connected for receiving the third current; and at least one second transistor coupled to the first transistor as a current mirror for sinking the fifth current.

8. The organic light emitting display as claimed in claim 7, wherein the second current sink unit comprises:

at least one third switch coupled to the second current generator, and being selectively turned on and turned off under a control of the controller;

at least one third transistor coupled to the first current generator, the at least one third transistor for receiving the fourth current supplied by the first current generator; and at least one fourth transistor coupled to the at least one third switch, and coupled to the at least one third transistor as a current mirror for sinking the sixth current.

9. The organic light emitting display as claimed in claim 8, wherein a number of fourth transistors coupled to the at least one third switch corresponds to $2^k$ (k=0, 1, 2, . . . ) for each third switch, wherein the at least one third switch comprises (k+1) switches.

10. The organic light emitting display as claimed in claim 8, wherein a number of the at least one third transistor is the same as the number of the at least one fourth transistor.

11. The organic light emitting display as claimed in claim 8, wherein the controller controls turning on and off of the at least one third switch so that the sixth current is sunk from the second current generator.

12. The organic light emitting display as claimed in claim 6, wherein the second current generator comprises:

at least one first transistor being diode-connected, wherein a sum current corresponding to the sum of the fifth current and the sixth current sunk by the first current sink unit and the second current sink unit, respectively, flows through the at least one first transistor; and at least one second transistor coupled to the first transistor as a current mirror for supplying the seventh current to the third current sink unit, the seventh current corresponding to the sum of the fifth current and the sixth current.

13. The organic light emitting display as claimed in claim 6, wherein the third current sink unit comprises:

at least one third switch coupled to the switching unit and being selectively turned on and off under a control of a data driver;

at least one first transistor coupled to the second current generator for receiving the seventh current; and at least one second transistor coupled to the at least one third switch, and coupled to the at least one first transistor as a current mirror for sinking the second current.

14. The organic light emitting display as claimed in claim 13, wherein the data driver controls turning on and off of the at least one third switch utilizing upper bits of the data to sink the second current, corresponding to the seventh current multiplied by the factor of β.

15. The organic light emitting display as claimed in claim 2, wherein one frame comprises a plurality of sub frames, and the sampling period is an initial period of the one frame.

16. The organic light emitting display as claimed in claim 2, wherein the sensing period corresponds to a time when a power is supplied to the organic light emitting display.

17. The organic light emitting display as claimed in claim 2, further comprising:

a data driver for selectively supplying a first data signal and a second data signal to data lines coupled to the pixels, the first data signal and the second data signal causing the pixels to emit light and not to emit light, respectively;

a scan driver for supplying a first scan signal and a second scan signal to first scan lines and second scan lines coupled to the pixels, respectively; and a control line driver for supplying a control signal to control lines coupled to the pixels.

18. The organic light emitting display as claimed in claim 17, wherein the data driver comprises:

a shift register unit for sequentially generating sampling signals;

a sampling latch unit for sequentially storing image data in response to the sampling signals and generating latched data;

a holding latch unit for temporarily storing the latched data from the sampling latch unit and generating holding data; and a signal generator for receiving lower bits of the holding data from the holding latch unit and for generating the first data signal or the second data signal, wherein upper bits of the holding data except the lower bits are supplied to the sensing unit.

19. The organic light emitting display as claimed in claim 17, wherein each of the pixels comprises:

a second transistor coupled to the feedback line, and being turned on when the first scan signal is supplied to the first scan line;

a first transistor including a gate electrode coupled to a second electrode of the second transistor, for supplying an electric current to the organic light emitting diode;

a first capacitor coupled between a gate electrode and a first electrode of the first transistor, the first capacitor being charged with a voltage corresponding to the second current;

a third transistor coupled between a second electrode of the first transistor and the feedback line, and being turned on when the first scan signal is supplied to the first scan line;

a fourth transistor coupled between the first transistor and the organic light emitting diode;

a second capacitor coupled between the fourth transistor and the first electrode of the first transistor, the second capacitor being charged with a voltage corresponding to the first data signal or the second data signal;

a fifth transistor coupled between the fourth transistor and the data line, and being turned on when the second scan signal is supplied to the second scan line; and a sixth transistor coupled between an anode electrode of the organic light emitting diode and the feedback line, and being turned on when a control signal is supplied to the control line.

20. The organic light emitting display as claimed in claim 19, wherein the fifth transistor is turned on during the sensing period and the sampling period to receive the second data signal from the data line.

21. The organic light emitting display as claimed in claim 19, wherein the sixth transistor is turned on during the sensing period.

22. The organic light emitting display as claimed in claim 19, wherein the second transistor and the third transistor are turned on during the sampling period.

23. The organic light emitting display as claimed in claim 19, wherein the second capacitor is charged with the voltage corresponding to the first data signal or the second data signal when the second scan signal is sequentially supplied during a sub frame period.

24. A method of driving an organic light emitting display, comprising:

supplying a first current to organic light emitting diodes included in pixels during a sensing period;

converting voltages applied to the organic light emitting diodes corresponding to the first current to digital values and storing the digital values in a memory;

sinking a second current from the pixels during a sampling period, wherein the second current is adapted, by utilizing the digital values stored in the memory, to compensate for a degradation of the organic light emitting diodes; and charging the pixels with a voltage corresponding to the second current while sinking the second current, wherein the second current is a function of a selected current value among I current values corresponding to a gradation of data, and a compensation current for compensating for the degradation of the organic light emitting diode, wherein I is a natural number.

25. The method as claimed in claim 24, wherein the digital values corresponding to each of the pixels are stored in the memory during the sensing period.

26. The method as claimed in claim 24, wherein the sensing period is when a power is supplied to the organic light emitting display.

27. The method as claimed in claim 24, wherein one frame comprises a plurality of sub frames, and the sampling period is an initial period of the one frame.

28. The method as claimed in claim 27, further comprising:

selectively supplying a first data signal and a second data signal to the pixels during a scan period of the sub frames, the first data signal and the second data signal causing the pixels to emit light and not to emit light, respectively; and supplying the second current to an organic light emitting diode of each of the pixels when the pixels receive the first data signal.

* * * * *